US006748911B2

(12) United States Patent
Katayama

(10) Patent No.: US 6,748,911 B2
(45) Date of Patent: Jun. 15, 2004

(54) VALVE TIMING CONTROL FOR MARINE ENGINE

(75) Inventor: Goichi Katayama, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/188,776

(22) Filed: Jul. 2, 2002

(65) Prior Publication Data

US 2003/0008573 A1 Jan. 9, 2003

(30) Foreign Application Priority Data

Jul. 2, 2001 (JP) ..... 2001-200430

(51) Int. Cl.[7] ..... F01L 1/34

(52) U.S. Cl. ..... 123/90.17; 123/90.11; 123/90.15; 123/195 P; 440/1; 440/2; 440/61 T; 440/61 G; 440/900

(58) Field of Search ..... 123/90.17, 90.11, 123/90.15, 90.31, 195 E, 195 P, 195 HC; 440/1, 2, 61 G, 61 T, 900

(56) References Cited

U.S. PATENT DOCUMENTS

| | | | |
|---|---|---|---|
| 4,565,528 A | 1/1986 | Nakase | 440/1 |
| 4,909,766 A | 3/1990 | Taguchi | 440/61 |
| 4,990,111 A | 2/1991 | Saitoh et al. | 440/61 |
| 5,012,773 A | 5/1991 | Akasaka et al. | 123/90.17 |
| 5,058,539 A | 10/1991 | Saito et al. | 123/90.17 |

(List continued on next page.)

FOREIGN PATENT DOCUMENTS

| | | |
|---|---|---|
| EP | 0 356 162 A1 | 2/1990 |
| EP | 0 699 831 A2 | 3/1996 |
| EP | 0 808 997 A1 | 11/1997 |
| EP | 0 829 621 A2 | 3/1998 |

OTHER PUBLICATIONS

U.S. Patent Application Publication 2003/0106515, Kondo, Jun. 12, 2003, Apparatus for Controlling Engine.*

Co–pending patent application Ser. No. 10/078,275, entitled Control System for Marine Engine, filed on Feb. 14, 2002 in the name of Isao Kanno and assigned to Sanshin Kogyo Kabushiki Kaisha.

*Primary Examiner*—Thomas Denion
*Assistant Examiner*—Kyle Riddle
(74) *Attorney, Agent, or Firm*—Knobbe, Martens, Olson & Bear, LLP

(57) ABSTRACT

An engine for a marine drive has a combustion chamber. An engine body of the engine defines an air intake port communicating with the combustion chamber. An air induction system communicates with the air intake port to introduce air to the combustion chamber through the air intake port. An exhaust system communicates with the combustion chamber through an exhaust port. Intake and exhaust valves move between an opening position and a closing position of the intake port and the exhaust port, respectively. Intake and exhaust camshafts actuate the intake valve and the exhaust valve, respectively. A VVT mechanism is associated with at least one of the camshafts and changes an actuating timing of the camshaft. The VVT mechanism includes a solenoid actuator that varies a hydraulic flow in the VVT mechanisms to change the actuating timing of the camshaft. The solenoid actuator can be operated to receive electric power from a power source. An ECU controls the solenoid actuator based upon a control characteristic. A sensor, such as a tilt operation sensor, senses an electrical component, such as an electric motor of a hydraulic tilt and trim adjustment system, is operated. The ECU adjusts the control characteristic when the electrical component is operated.

23 Claims, 9 Drawing Sheets

U.S. PATENT DOCUMENTS 5,111,780 A 5/1992 Hannibal ..... 123/90.17
5,133,310 A 7/1992 Hitomi et al. ..... 123/90.15
5,143,034 A 9/1992 Hirose ..... 123/196 R
5,150,675 A 9/1992 Murata ..... 123/193.5
5,184,581 A 2/1993 Aoyama et al. ..... 123/90.31
5,189,999 A 3/1993 Thoma ..... 123/90.17
5,301,639 A 4/1994 Satou ..... 123/90.17
5,305,718 A 4/1994 Muller ..... 123/90.17
5,353,755 A 10/1994 Matsuo et al. ..... 123/90.13
5,458,099 A 10/1995 Koller et al. ..... 123/193.5
5,474,038 A 12/1995 Golovatai-Schmidt et al. ..... 123/90.17
5,540,197 A 7/1996 Golovatai-Schmidt et al. ..... 123/90.17
5,606,941 A 3/1997 Trzmiel et al. ..... 123/90.15
5,606,952 A 3/1997 Kanno et al. ..... 123/413
5,669,343 A 9/1997 Adachi ..... 123/90.17
5,694,895 A * 12/1997 Tsunoda et al. ..... 123/179.24
5,713,319 A 2/1998 Tortul ..... 123/90.17
5,718,196 A 2/1998 Uchiyama et al. ..... 123/195 C
5,758,612 A 6/1998 Tsuzuku et al. ..... 123/90.16
5,797,363 A 8/1998 Nakamura ..... 123/90.17
5,799,631 A 9/1998 Nakamura ..... 123/90.17
5,813,377 A 9/1998 Matsunaga ..... 123/90.17
5,826,560 A 10/1998 Ito ..... 123/315
5,829,399 A 11/1998 Scheidt et al. ..... 123/90.17
5,836,274 A 11/1998 Saito et al. ..... 123/90.16
5,855,190 A 1/1999 Matsunaga ..... 123/90.17
5,913,298 A 6/1999 Yoshikawa ..... 123/306
5,924,395 A * 7/1999 Moriya et al. ..... 123/90.15
5,954,019 A 9/1999 Yoshikawa et al. ..... 123/90.17
5,957,095 A * 9/1999 Kako ..... 123/90.15
6,015,319 A 1/2000 Tanaka ..... 440/84
6,032,629 A 3/2000 Uchida ..... 123/90.34
6,035,817 A 3/2000 Uchida ..... 123/90.17
6,076,492 A 6/2000 Takahashi ..... 123/90.17
6,116,228 A 9/2000 Motose et al. ..... 123/679
6,186,105 B1 2/2001 Yonezawa ..... 123/90.17
6,189,498 B1 2/2001 Yonezawa et al. ..... 123/94.15
6,250,266 B1 6/2001 Okui et al. ..... 123/90.17
6,289,861 B1 9/2001 Suzuki ..... 123/90.17
6,318,313 B1 * 11/2001 Moriya et al. ..... 123/90.15
6,325,031 B1 12/2001 Takano ..... 123/90.17
6,343,580 B2 2/2002 Uchida ..... 123/90.17
6,343,581 B2 2/2002 Suzuki ..... 123/90.17
6,354,277 B1 3/2002 Kato ..... 123/492
6,357,405 B1 3/2002 Tsuji et al. ..... 123/90.16
2002/0017277 A1 2/2002 Kanno ..... 123/406.59

* cited by examiner

VALVE TIMING CONTROL FOR MARINE ENGINE

PRIORITY INFORMATION

This application is based on and claims priority to Japanese Patent Application No. 2001-200430, filed Jul. 2, 2001, the entire contents of which is hereby expressly incorporated by reference.

BACKGROUND OF THE INVENTION

1. Field of the Invention

The present invention is directed to a valve timing control for an engine, and more particularly to an improved valve timing control for an engine that includes a variable valve timing mechanism.

2. Description of Related Art

Recently, four-cycle engines with variable valve timing have become more widely used. Typically, a four-cycle engine includes one or more intake valves and exhaust valves moving between an opening position and a closing position of intake ports and exhaust ports, respectively. One or more camshafts can be provided to actuate the valves in a timed manner. With the intake valves opened, air is introduced into combustion chambers of the engine through the intake ports. With the exhaust valves opened, exhaust gases are discharged from the combustion chambers through the exhaust ports.

The engine can include a hydraulically operated variable valve timing (VVT) mechanism that can change the opening and closing timing of respective valves by changing an angular position of the camshaft relative to the crankshaft. A control module such as, for example, an electronic control unit (ECU) is used to control the VVT mechanism under various control strategies. For example, the ECU can control the VVT mechanism adjust the valve timing between a fully advanced position and a fully retarded position. The fully advanced position is used for relatively high engine speeds to ensure high charging efficiency and high performance of the engine. The fully retarded position is used for relatively low engine speeds to ensure high combustion efficiency, fuel economy and good emission control. Otherwise, the ECU controls the VVT mechanism to set the valve timing at a position between the fully advanced position and the fully retarded position in response to a running condition of the engine.

The control strategy can be stored in the ECU as a control routine, or the ECU can be hard-wired to perform the desired control. With the output of appropriate sensors, the ECU can thus perform feedback control to adjust the VVT mechanism in accordance with a desired control characteristic.

The VVT mechanism can comprise an electrically operable unit such as, for example, a solenoid actuator that varies a hydraulic flow in the VVT mechanism. Typically, the solenoid actuator is connected to a battery which supplies electric power not only to the solenoid actuator, but also to a number of other electrical components.

SUMMARY OF THE INVENTION

One aspect of the present invention is the realization that in applications where another electrical accessory is used intermittently during operation of the engine, the accessory can cause the voltage in the corresponding electrical system to drop and thereby cause interference with accurate VVT control.

For example, marine drives such as outboard motors and stern drives, are relatively more vulnerable to a voltage drop. Typically, a marine drive must fit into a relatively narrow space and thus can only include a small size alternator. Such an alternator cannot supply large power to the battery. Accordingly, sufficient current cannot be supplied to electrical components of the marine drive if, for example, multiple electrical components are operated simultaneously. Occasionally, operation of the electrical components connected to the battery of the marine drive can consume so much power that some of the energy stored in the battery is drained while the engine is operating. Such electrical accessories can include, for example but without limitation, lighting implements and a net winch can be used when the engine operates.

Outboard motors typically include a hydraulic tilt and trim adjustment system which can tilt (raise or lower) a housing unit thereof. The tilt system can be frequently and intermittently activated during operation of the engine. Such a tilt system typically comprises an electric motor that drives a hydraulic pump. Such an electric motor can draw a relatively large current.

When such an electric accessory is activated, the resulting voltage drop in the electrical system can cause a significant problem with the VVT mechanism operation. For example, as noted above, the solenoid of the VVT mechanism draws power from the battery. Thus, when there is a voltage drop in the electrical system, the performance of the solenoid is affected. In particular, the solenoid can react more slowly than expected, and thus fail to provide the actuation needed to achieve the desired VVT adjustment.

A need therefore exists for an improved valve timing control for an engine that can control a VVT mechanism accurately even if a voltage drop occurs at the power source of the VVT mechanism.

In accordance with another aspect of the present invention, an internal combustion engine comprises an engine body. A movable member is movable relative to the engine body, the engine body and the movable member together defining a combustion chamber. The engine body defines intake and exhaust ports communicating with the combustion chamber. An air induction system communicates with the combustion chamber through the intake port. An exhaust system communicates with the combustion chamber through the exhaust port. An intake valve is arranged to move between an open position and a closed position of the intake port. An exhaust valve is arranged to move between an open position and a closed position of the exhaust port. A valve actuator is arranged to actuate one of the intake valve and the exhaust valve. A valve actuator adjustment mechanism includes an electric actuator configured to adjust an actuating timing of the valve actuator at which the valve actuator actuates the intake valve or the exhaust valve. A control module is configured to control the electric actuator based upon a control characteristic. At least one sensor is configured to detect when a second electrical component is operated. The control module is configured to adjust the control characteristic when the second electrical component is operated.

In accordance with another aspect of the present invention, an outboard motor comprises a housing unit, and an internal combustion engine supported by the housing unit. A bracket assembly is adapted to mount the housing unit on an associated watercraft for a tilt movement about a generally horizontally extending tilt axis. A tilt mechanism is configured to tilt the housing unit about the tilt axis. The tilt mechanism includes an electrical component. The engine comprises an engine body, and a movable member movable relative to the engine body. The engine body and the movable member together defining a combustion chamber. The engine body also defines intake and exhaust ports communicating with the combustion chamber. An air induction system communicates with the combustion chamber through the intake port. An exhaust system communicates with the combustion chamber through the exhaust port. An intake valve is arranged to move between an open position and a closed position of the intake port. An exhaust valve is arranged to move between an open position and a closed position of the exhaust port. A valve actuator is configured to actuate either the intake valve or the exhaust valve. A hydraulic change mechanism is configured to change an actuating timing of the valve actuator at which the valve actuator actuates the intake valve or the exhaust valve. The change mechanism includes an electrically operable member varying a hydraulic flow in the change mechanism to change the actuating timing of the valve actuator. The electrically operable unit being adapted to be supplied with electric power from a power source. A control module is configured to control the electrically operable member based upon a control characteristic. The electrical component is adapted to be supplied with electric power from the power source. A tilt sensor is configured to sense when the electrical component is operated and to send a signal indicative that the electrical component is operating to the control module, the control module adjusting the control characteristic in accordance with the signal from the sensor.

A further aspect of the present invention is directed to a method for controlling an internal combustion engine. The engine includes intake and exhaust valves, a valve actuator arranged to actuate the intake and exhaust valves, and a hydraulic change mechanism configured to change an actuating timing of the valve actuator at which the valve actuator actuates at least one of the intake valve and the exhaust valve. The method includes changing the actuating timing based upon a control characteristic, supplying electric power to an electrically operable member of the change mechanism from a power source, and sensing when an electrical component connected to the power source is operated to receive the electric power from the power source. Additionally, the method includes adjusting the control characteristic when the electrical component is operated.

Another aspect of the present invention is directed to a method for controlling an outboard motor. The outboard motor includes a tilt mechanism and an internal combustion engine. The engine includes intake and exhaust valves, a valve actuator arranged to actuate the intake and exhaust valves, and a hydraulic change mechanism arranged to change an actuating timing of the valve actuator at which the valve actuator actuates at least one of the intake valve and the exhaust valve. The method includes changing the actuating timing based upon a control characteristic, supplying electric power to an electrically operable member of the change mechanism from a power source, supplying electric power to an electrical component of the tilt mechanism from the power source, and sensing the electrical component is operated to receive the electric power from the power source. The method also includes adjusting the control characteristic when the electrical component is operated.

In accordance with a further aspect of the present invention, an engine includes an engine body, a shaft rotatably journalled for rotation at least partially within the engine body, and at least one valve seat. At least one valve is configured to move between an open position relative to the valve seat and a closed position relative to the valve seat. A valve actuator is configured to move the valve between the open and closed positions in accordance with a timing relative to rotation of the shaft. A timing adjustment device is powered by an electrical system and is configured to adjust the timing. A control module is configured to determine a target timing and to send an output signal to the timing adjustment device to adjust the timing towards the target timing. At least a first electrical component is powered by the electrical system. The first electrical component is selectively operable by a user and causes a significant voltage drop in the electrical system when activated. Additionally, the engine includes means for adjusting a magnitude of the output signal when the first electrical component is activated

BRIEF DESCRIPTION OF THE DRAWINGS

These and other features, aspects and advantages of the present invention will now be described with reference to the drawings of several preferred embodiments, which are intended to illustrate and not to limit the invention. The drawings comprise nine figures.

DETAILED DESCRIPTION OF THE PREFERRED EMBODIMENTS OF THE INVENTION

Figure 1:
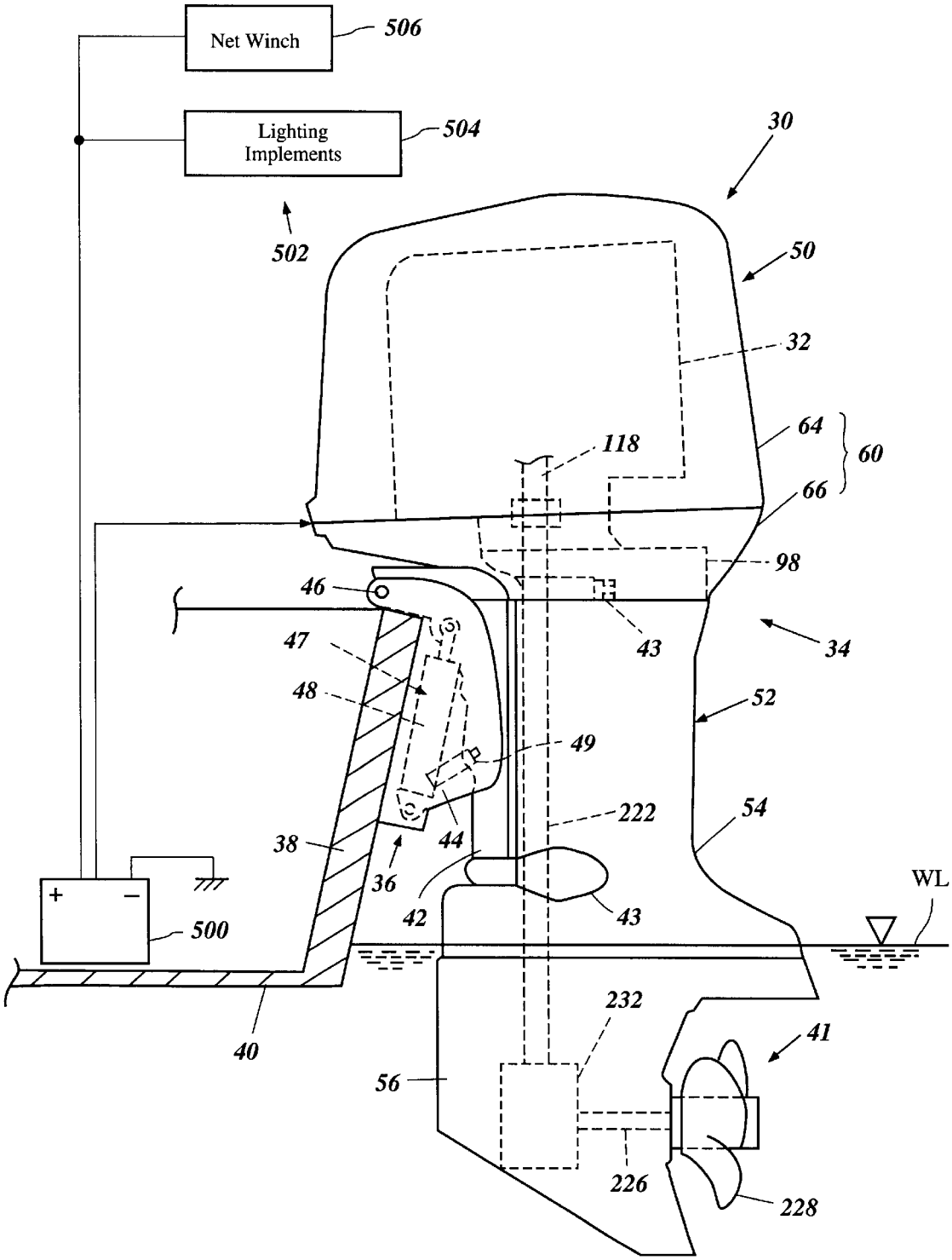
FIG. 1 is a side elevational view of an outboard motor configured in accordance with a preferred embodiment of the present invention. Some internal components, e.g., an engine, are shown in phantom. A corresponding watercraft is partially shown in section.

With reference to FIGS. 1–5, an overall construction of an outboard motor 30 that employs an internal combustion engine 32 configured in accordance with certain features, aspects and advantages of the present invention is described below. The engine 32 has particular utility in the context of a marine drive, such as the outboard motor, and thus is described in the context of an outboard motor. The engine 32, however, can be used with other types of marine drives (i.e., inboard motors, inboard/outboard motors, etc.) as well as land vehicles. Furthermore, the engine 32 can be used as a stationary engine for some applications that are apparent to those of ordinary skill in the art, in light of the disclosure set forth herein.

In the illustrated arrangement, the outboard motor 30 includes a drive unit 34 and a bracket assembly 36. The bracket assembly 36 supports the drive unit 34 on a transom 38 of an associated watercraft 40 such that a marine propulsion device 41 is in a submerged position with the watercraft 40 resting relative to a surface of a body of water WL. The bracket assembly 36 preferably comprises a swivel bracket 42, a clamping bracket 44, a steering shaft and a pivot pin 46.

The steering shaft typically extends through the swivel bracket 42 and is affixed to the drive unit 34 by top and bottom mount assemblies 43. The steering shaft is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system 47 preferably is provided between the swivel bracket 42 and the clamping bracket 44 for tilt movement (raising or lowering) of the swivel bracket 42 and the drive unit 34 relative to the clamping bracket 44.

The hydraulic tilt system 47 preferably comprises a single tilt cylinder unit 48, a pair of trim adjustment cylinder units 49, a fluid pump (not shown), an electric motor (not shown) and control valves (not shown). The trim units 49 preferably are disposed on the sides of the tilt unit 48. Lower ends of the trim units 49 preferably are coupled with a lower end of the tilt unit 48.

Each cylinder unit 48, 49 comprises a cylinder body containing working fluid and a piston slideably moveable within the cylinder body which defines upper and lower chambers together with the cylinder body. A piston rod is affixed to the piston and extends beyond an upper end of the cylinder body. A lower end of the cylinder body is closed.

The fluid pump is connected to both the upper and lower chambers through the control valves and pressurizes the working fluid to move the piston within the cylinder body. The electric motor can drive the fluid pump in forward and reverse directions. Thus, the piston rod can either extend outwardly from the cylinder body or retract inwardly in accordance with the fluid pump being driven by the electric motor in the forward and reverse directions, respectively.

The lower ends of the tilt unit 48 and the trim units 49 are supported by a horizontally extending mount pin journaled on the clamping bracket 44 for pivotal movement. An upper end of the tilt unit 48, in turn, is supported by another horizontally extending mount pin journaled on the swivel bracket 42 for pivotal movement. The respective upper ends of the trim unit 49 abut a front surface of the swivel bracket 42. Accordingly, with the extension or retraction of the piston rod of the tilt cylinder unit 48, the swivel bracket 42 together with the drive unit 34 can move between the fully tilted down position and the fully tilted up position. In a similar manner, with the extension or retraction of the piston rods of the trim cylinder units 49, the swivel bracket 42 together with the drive unit 34 can move between the fully trimmed down position and the fully trimmed up position. A trim adjustment range overlaps with a lower part of the tilt range. Typically, the trim units 49 control movement within the lower part of the tilt range, while the tilt unit 48 controls movement over the remaining upper part of the tilt range.

The outboard motor 30 can have a manually operated tilt system in some arrangements. The term "tilt", when used in a broad sense, can mean both "tilt" and "trim adjustment" in this description. The hydraulic tilt and trim adjustment system is disclosed in, for example, U.S. Pat. Nos. 4,565,528, 4,909,766 and 4,990,111, the entire contents of which are hereby expressly incorporated by reference.

The illustrated drive unit 34 comprises a power head 50 and a housing unit 52 which includes a driveshaft housing 54 and a lower unit 56. The power head 50 is disposed atop the drive unit 34 and includes the internal combustion engine 32 and a protective cowling assembly 60.

Preferably, the protective cowling 60, which preferably is made of plastic, defines a generally closed cavity 62 (FIGS. 2–4) in which the engine 32 is disposed. The protective cowling assembly 60 preferably comprises a top cowling member 64 and a bottom cowling member 66. The top cowling member 64 preferably is detachably affixed to the bottom cowling member 66 by a coupling mechanism so that a user, operator, mechanic or repair person can access the engine 32 for maintenance or for other purposes.

Figure 2:
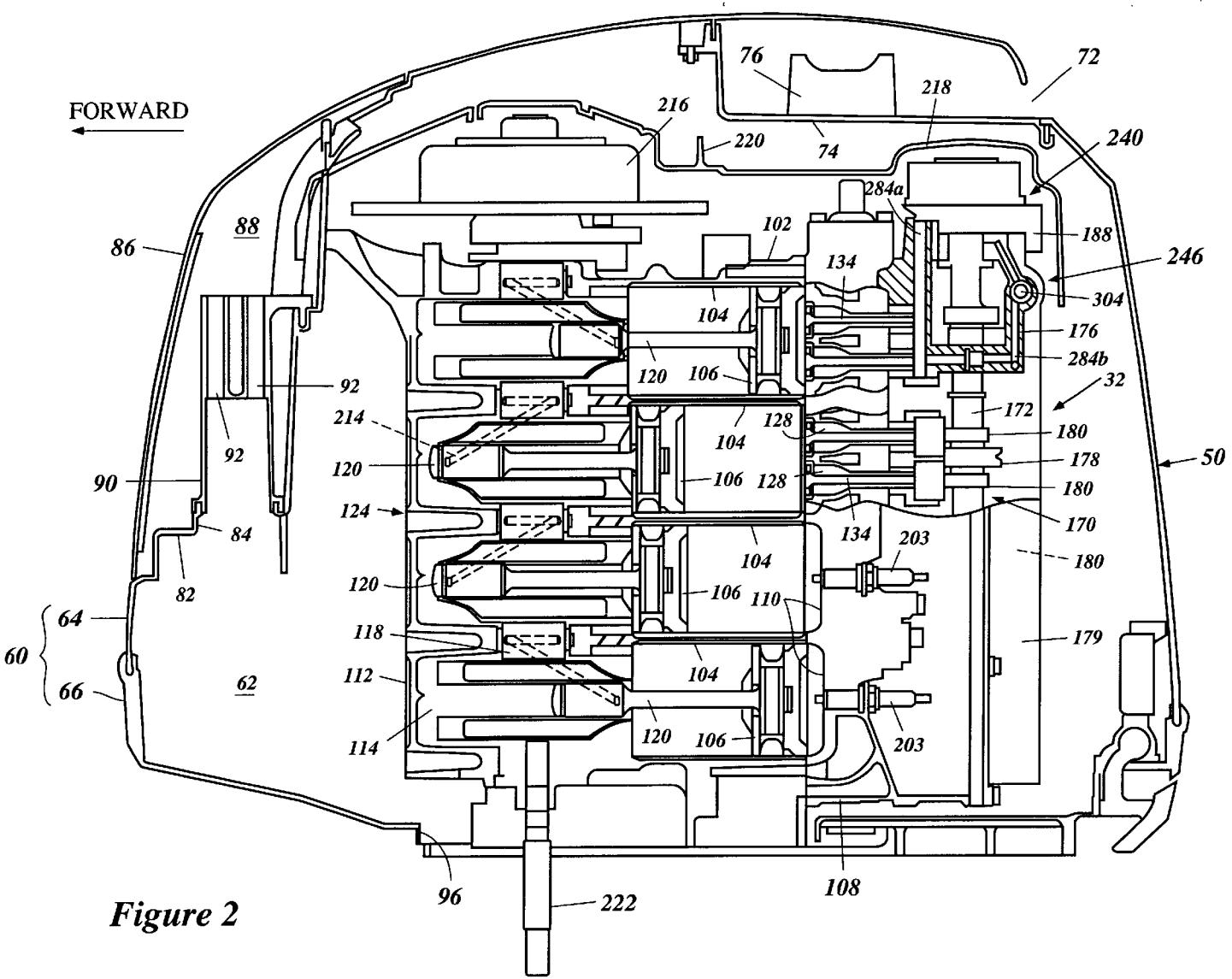
FIG. 2 is a partial sectional and port side elevational view of a power head of the outboard motor shown in FIG. 1. A camshaft drive mechanism generally is omitted in this figure except for an intake camshaft driven sprocket.
Figure 4:
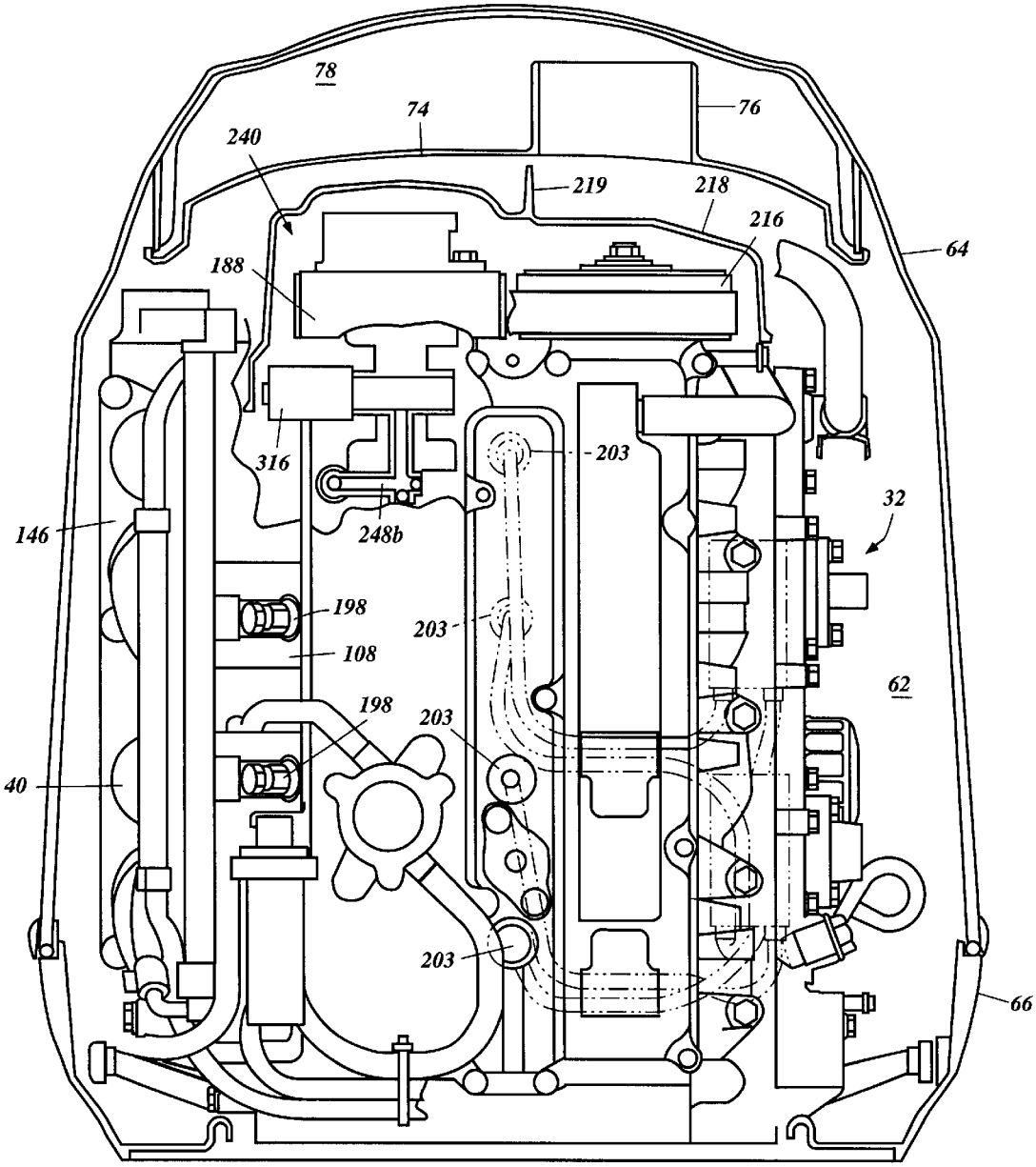
FIG. 4 is a partial sectional and rear elevational view of the power head. The cowling assembly is shown in section.

With reference to FIG. 2, the top cowling member 64 preferably has a rear intake opening 72 on its rear and top portion. A rear intake member 74 with a rear air duct 76 is affixed to the top cowling member 64. The rear intake member 74, together with the rear top portion of the top cowling member 64, forms a rear air intake space 78. With particular reference to FIG. 4, the rear air duct 76 preferably is disposed to the starboard side of a central portion of the rear intake member 74.

With reference to FIG. 2, the top cowling member 64 also defines a recessed portion 82 at a front end thereof. An opening 84 is defined along a portion of the recessed portion 82 on the starboard side. The opening 84 extends into the interior of the top cowling member 64. An outer shell 86 is disposed over the recessed portion 82 to define a front air intake space 88. A front air duct 90 is affixed to the recessed portion 82 of the top cowling member 64 and extends upward from the opening 84. In this manner, the air flow path into the closed cavity 62 can include an elevated entrance from the front air intake space 88. The air duct 90 preferably has a plurality of apertures 92, each of which preferably is cylindrical.

A front intake opening (not shown) preferably is defined between the recessed portion 82 of the top cowling member 82 and the outer shell 86 so that the front intake space 88 communicates with outside of the cowling assembly 60. Ambient air thus is drawn into the closed cavity 62 through the rear intake opening 72 or the front intake opening (not shown) and further through the air ducts 76, 90. Typically, the top cowling member 64 tapers in girth toward its top surface, which is in the general proximity of the air intake opening 72.

The bottom cowling member 66 preferably has an opening 96 (FIG. 2) through which an upper portion of an exhaust guide member 98 (FIG. 1) extends. The exhaust guide member 98 preferably is made of aluminum alloy and is affixed atop the driveshaft housing 54. The bottom cowling member 66 and the exhaust guide member 98 together generally form a tray. The engine 32 is placed onto this tray and is affixed to the exhaust guide member 98. The exhaust guide member 98 also has an exhaust passage through which burnt charges (e.g., exhaust gases) from the engine 32 are discharged.

Figure 3:
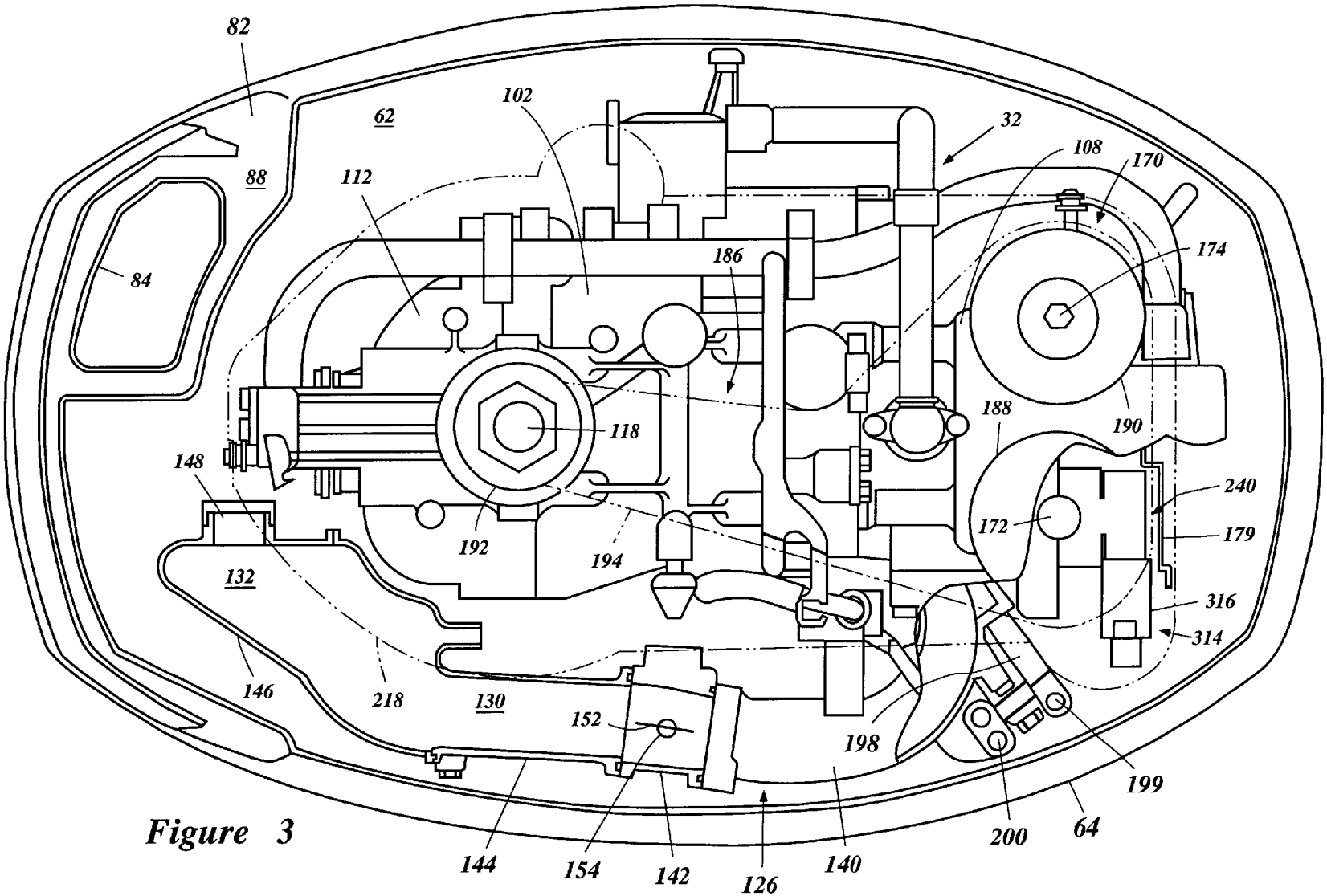
FIG. 3 is a partial sectional and top plan view of the power head. A cowling assembly is shown in section. The engine is partially illustrated in section.

With particular reference to FIGS. 2–4, the engine 32 in the illustrated embodiment preferably operates on a four-cycle combustion principle. The engine 32 has a cylinder block 102. The presently preferred cylinder block 102 defines in-line four cylinder bores 104 which extend generally horizontally and which are generally vertically spaced from one another.

As used in this description, the term "horizontally" means that the subject portions, members, or components extend generally in parallel to the water line WL when the associated watercraft 40 is substantially stationary with respect to the water line WL and when the drive unit 34 is not tilted and is placed in the position shown in FIG. 1. The term "vertically" in turn means that the portions, members, or components extend generally normal to those that extend horizontally. This type of engine, however, merely exemplifies one type of engine on which various aspects and features of the present invention can be suitably used. Engines having other numbers of cylinders, having other cylinder arrangements (V, W, opposing, etc.), and operating on other combustion principles (e.g., crankcase compression two-stroke, diesel, or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

A moveable member, such as a reciprocating piston 106, moves relative to the cylinder block 102 in a suitable manner. In the illustrated arrangement, a piston 106 reciprocates within each cylinder bore 104.

A cylinder head member 108 is affixed to one end of the cylinder block 102 to close that end of the cylinder bores 104. The cylinder head member 108, together with the associated pistons 106 and cylinder bores 104, preferably defines four combustion chambers 110. Of course, the number of combustion chambers can vary, as indicated above.

A crankcase member 112 closes the other end of the cylinder bores 104 and, together with the cylinder block 102, defines a crankcase chamber 114. A crankshaft or output shaft 118 extends generally vertically through the crankcase chamber 114 and can be journaled for rotation by several bearing blocks (not shown). Connecting rods 120 couple the crankshaft 118 with the respective pistons 106 in any suitable manner. Thus, the crankshaft 118 can rotate with the reciprocal movement of the pistons 106.

Preferably, the crankcase member 112 is located at the forward-most position of the engine 32, with the cylinder block 102 and the cylinder head member 108 being disposed rearward from the crankcase member 112, one after another. Generally, the cylinder block 102 (or individual cylinder bodies), the cylinder head member 108, and the crankcase member 112 together define an engine body 124. Preferably, at least these major engine portions 102, 108, 112 are made of an aluminum alloy. The aluminum alloy advantageously increases strength over cast iron while decreasing the weight of the engine body 96.

The engine 32 also comprises an air induction system or device 126. The air induction system 126 draws air from within the cavity 62 to the combustion chambers 110. The air induction system 126 preferably comprises eight intake ports 128, four intake passages 130, and a single plenum chamber 132. In the illustrated arrangement, two intake ports 128 are allotted to each combustion chamber 110 and the two intake ports 128 communicate with a single intake passage 130.

The intake ports 128 are defined in the cylinder head member 108. Intake valves 134 are slidably disposed at the cylinder head member 108 to move between an open position and a closed position of the intake ports 128. As such, the valves 134 act to open and close the ports 128 to control the flow of air into the combustion chamber 110.

Biasing members, such as springs 136 (FIG. 5), are arranged to urge the intake valves 134 toward the respective closed positions by acting against a mounting boss formed on the illustrated cylinder head member 108 and a corresponding retainer 138 that is affixed to each of the valves 134. When each intake valve 134 is in the open position, the intake passage 130 that is associated with the intake port 128 communicates with the associated combustion chamber 110.

With reference to FIG. 3, each intake passage 130 preferably is defined by an intake manifold 140, a throttle body 142, and an intake runner 144. The intake manifold 140 and the throttle body 142 preferably are made of aluminum alloy, while the intake runner 144 preferably is made of plastic. A portion of the illustrated intake runner 144 extends forwardly alongside of and to the front of the crankcase member 112.

With continued reference to FIG. 3, the respective portions of the intake runners 144, together with a plenum chamber member 146, define the plenum chamber 132. Preferably, the plenum chamber member 146 also is made of plastic. The plenum chamber 132 comprises an air inlet 148. The air in the closed cavity 62 is drawn into the plenum chamber 132 through the air inlet 148. The air is then passed through intake passages 130, the throttle body 142 and the intake manifold 140. In some arrangements, the plenum chamber 132 acts as an intake silencer to attenuate the noise generated by the flow of air into the respective combustion chambers 110.

Each illustrated throttle body 142 has a butterfly type throttle valve 152 journaled for pivotal movement about an axis defined by a generally vertically extending valve shaft 154. Each valve shaft 154 can be coupled with the other valve shafts to allow simultaneous movement. Thus, the valve shaft 154 is operable by the operator through an appropriate conventional throttle valve linkage and a throttle lever connected to the end of the linkage. The throttle valves 152 are movable between an open position and a closed position to meter or regulate an amount of air flowing through the respective air intake passages 130. Normally, the greater the opening degree, the higher the rate of airflow and the higher the power output from the engine.

In order to bring the engine 32 to idle speed and to maintain this speed, the throttle valves 152 generally are substantially closed. Preferably, the valves are not fully closed to produce a more stable idle speed and to prevent sticking of the throttle valves 152 in the closed position. As used through the description, the term "idle speed" generally means a low engine speed that achieved when the throttle valves 152 are closed but also includes a state such that the valves 152 are slightly more open to allow a relatively small amount of air to flow through the intake passages 130.

The air induction system 126 preferably includes an auxiliary air device (AAD) (not shown) that bypasses the throttle valves 152 and extends from the plenum chamber 132 to the respective intake passages 130 downstream of the throttle valves 152. Idle air can be delivered to the combustion chambers 110 through the AAD when the throttle valves 152 are placed in a substantially closed or closed position.

The AAD preferably comprises an idle air passage, an idle valve, and an idle valve actuator (not shown). The idle air passage is branched off to the respective intake passages 130. The idle valve controls flow through the idle air passage such that the amount of air flow can be fine-tuned. Preferably, the idle valve is a needle valve that can move between an open position and a closed position, which closes the idle air passage. The idle valve actuator actuates the idle valve to a certain position to measure or adjust an amount of the idle air.

Figure 8:
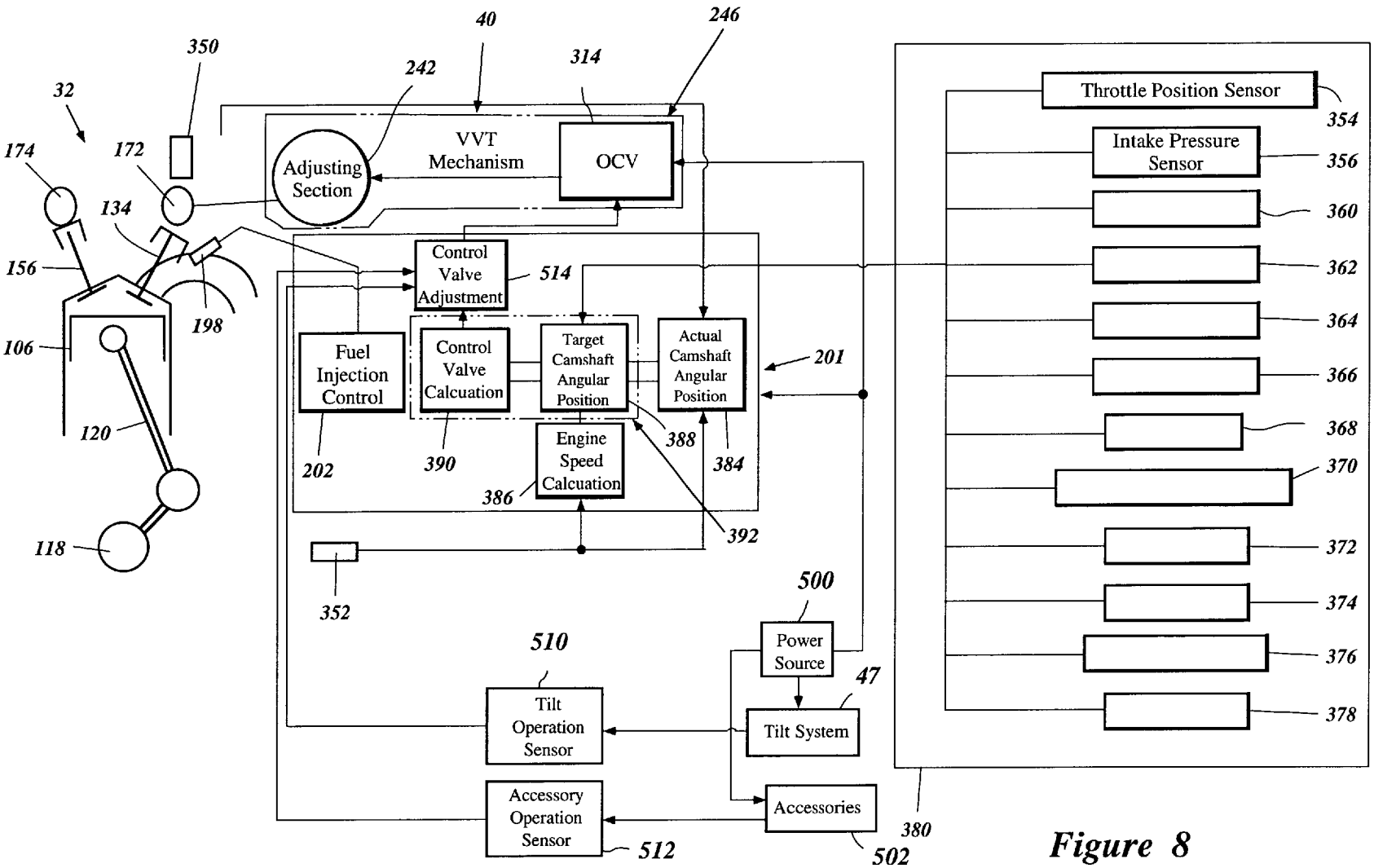
FIG. 8 is a schematic illustration of a control system of the VVT mechanism.

The engine 32 also comprises an exhaust system that guides burnt charges, i.e., exhaust gases, to a location outside of the outboard motor 30. Each cylinder bore 104 preferably has two exhaust ports (not shown) defined in the cylinder head member 108. The exhaust ports can be selectively opened and closed by exhaust valves. The exhaust valves are schematically illustrated in FIG. 8, described in greater detail below, and identified by the reference numeral 156. The construction of each exhaust valve and the arrangement of the exhaust valves are substantially the same as the intake valves 134 and the arrangement thereof, respectively.

An exhaust manifold (not shown) preferably is disposed next to the exhaust ports (not shown) and extends generally vertically. The exhaust manifold communicates with the combustion chambers 110 through the exhaust ports to collect exhaust gases therefrom. The exhaust manifold is coupled with the foregoing exhaust passage (not shown) of the exhaust guide member 98. When the exhaust ports are opened, the combustion chambers 110 communicate with the exhaust passage through the exhaust manifold.

Figure 5:
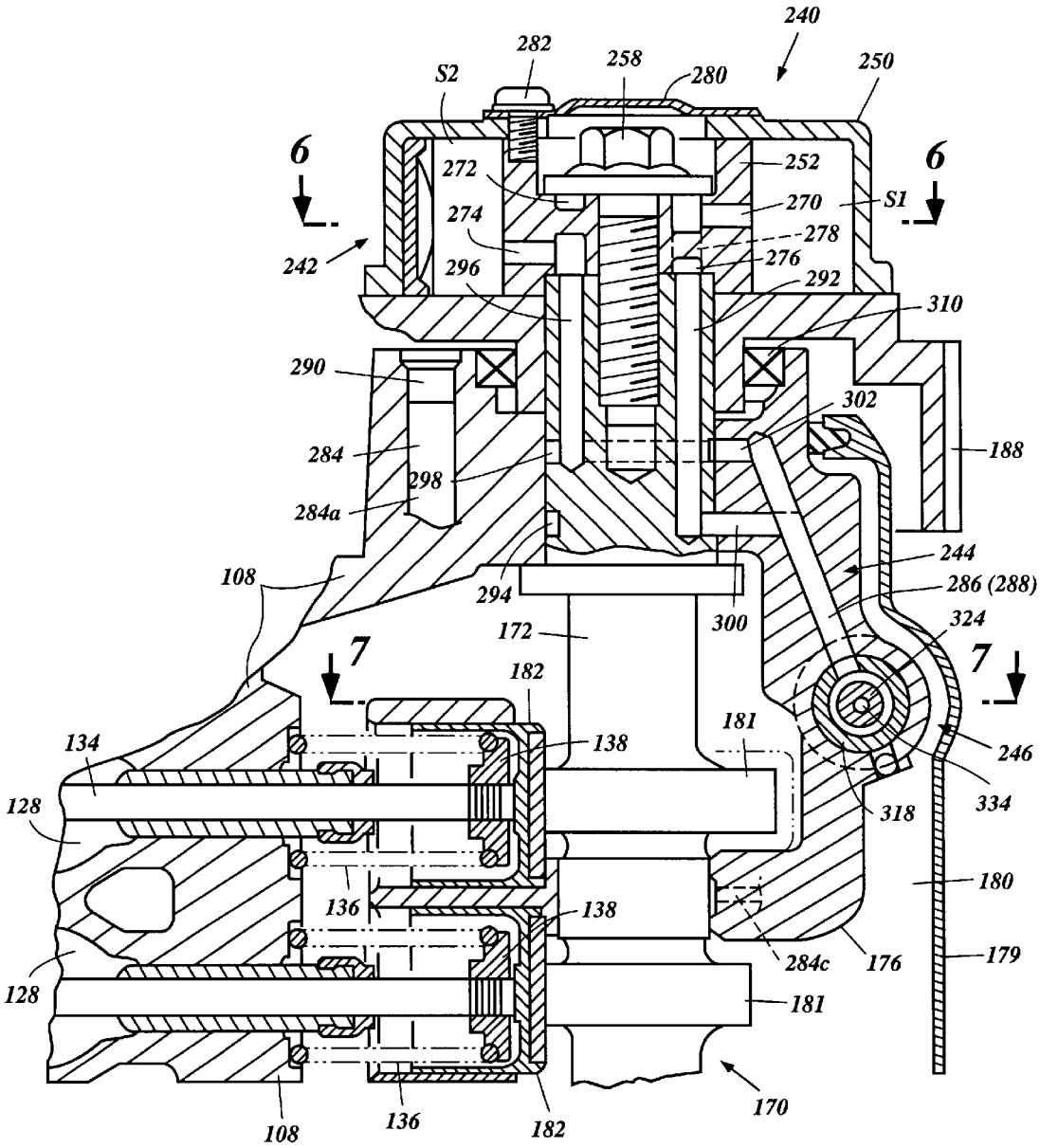
FIG. 5 is an enlarged, sectional view of a VVT mechanism of the engine.

With particular reference to FIGS. 2, 3 and 5, a valve cam mechanism or valve actuator 170 preferably is provided for actuating the intake valves 134 and the exhaust valves 156 (FIG. 8). In the illustrated arrangement, the valve cam mechanism 170 includes an intake camshaft 172 and an exhaust camshaft 174, both of which extend generally vertically and are journaled for rotation relative to the cylinder head member 108. In the illustrated arrangement, bearing caps 176, 178 (FIG. 2) journal the camshafts 172, 174 with the cylinder head member 108. A camshaft cover 179 is affixed to the cylinder head member 108 to define a camshaft chamber 180 together with the cylinder head member 108.

Each camshaft 172, 174, as shown in FIG. 5, has cam lobes 181 to push valve lifters 182 that are affixed to the respective ends of the intake valves 134 and exhaust valves 156 (FIG. 8) as in any suitable manner. The cam lobes 181 repeatedly push the valve lifters 182 in a timed manner, which is in proportion to the engine speed. The movement of the lifters 182 generally is timed by the rotation of the camshafts 172, 174 to appropriately actuate the intake valves 134 and the exhaust valves.

With particular reference to FIG. 3, a camshaft drive mechanism 186 drives the valve cam mechanism 170. The intake camshaft 172 includes an intake driven sprocket 188 positioned atop the intake camshaft 172 and the exhaust camshaft 174 includes an exhaust driven sprocket 190 positioned atop the exhaust camshaft 174. The crankshaft 118 has a drive sprocket 192 positioned at an upper portion thereof. Of course, other locations of the sprockets also can be used. The illustrated arrangement, however, advantageously results in a compactly arranged engine.

A timing chain or belt 194 is wound around the driven sprockets 188, 190 and the drive sprocket 192. The crankshaft 118 thus drives the respective camshafts 172, 174 through the timing chain 194 in the timed relationship. Because the camshafts 172, 174 must rotate at half of the speed of the rotation of the crankshaft 118 in the four-cycle combustion principle, a diameter of the driven sprockets 188, 190 is twice as large as a diameter of the drive sprocket 192.

With reference to FIGS. 3 and 4, the engine 32 preferably has a port or manifold fuel injection system. The fuel injection system preferably comprises four fuel injectors 198 with one fuel injector allotted for each of the respective combustion chambers 110 through suitable fuel conduits, such as fuel rails 199. The fuel injectors 198 are mounted on the fuel rail 199, which is mounted on the cylinder head member 108. Each fuel injector 198 preferably has an injection nozzle directed toward the associated intake passage 130 adjacent to the intake ports 134. Preferably, at least one fuel cooler 200 is disposed in thermal communication with the fuel rail 199, to thereby cool fuel flowing through the fuel rail 199. The fuel cooler 200 can be supplied with coolant from the cooling system, described in greater detail below.

In operation, the fuel injectors 198 spray fuel into the intake passages 130 under control of an ECU which preferably is mounted on the engine body 124 at an appropriate location. The ECU, which is shown in FIG. 8 and is identified with the reference numeral 201, controls both the start timing and the duration of the fuel injection cycle of the fuel injectors 198 so that the nozzles spray a proper amount of the fuel per combustion cycle. This control also is illustrated in FIG. 8 with reference numeral 202 and is described in greater detail below. Of course, the fuel injectors 198 can be disposed for direct cylinder injection or carburetors can replace or accompany the fuel injectors 198.

With reference to FIGS. 2 and 4, the engine 32 further comprises an ignition or firing system. Each combustion chamber 110 is provided with a spark plug 203 that is connected to the ECU 201 (FIG. 8) through an igniter so that ignition timing is also controlled by the ECU 201. Each spark plug 203 has electrodes that are exposed into the associated combustion chamber and are spaced apart from each other with a small gap. The spark plugs 203 generate a spark between the electrodes to ignite an air/fuel charge in the combustion chamber 110 at selected ignition timing under control of the ECU 201.

In the illustrated engine 32, the pistons 106 reciprocate between top dead center and bottom dead center. When the crankshaft 118 makes two rotations, the pistons 106 generally move from the top dead center to the bottom dead center (the intake stroke), from the bottom dead center to the top dead center (the compression stroke), from the top dead center to the bottom dead center (the power stroke) and from the bottom dead center to the top dead center (the exhaust stroke). During the four strokes of the pistons 106, the camshafts 172, 174 make one rotation and actuate the intake valves 134 and the exhaust valves 156 (FIG. 8) to open the intake ports 128 during the intake stroke and to open exhaust ports during the exhaust stroke, respectively.

Generally, during the intake stroke, air is drawn into the combustion chambers 110 through the air intake passages 130 and fuel is injected into the intake passages 130 by the fuel injectors 198. The air and the fuel thus are mixed to form the air/fuel charge in the combustion chambers 110. Slightly before or during the power stroke, the respective spark plugs 203 ignite the compressed air/fuel charge in the respective combustion chambers 110. The air/fuel charge thus rapidly burns during the power stroke to move the pistons 106. The burnt charge, i.e., exhaust gases, then are discharged from the combustion chambers 110 during the exhaust stroke.

During engine operation, heat builds in the engine body 124. The illustrated engine 32 thus includes a cooling system to cool the engine body 124. The outboard motor 30 preferably employs an open-loop type water cooling system that introduces cooling water from the body of water surrounding the motor 30 and then discharges the water to the water body. The cooling system includes one or more water jackets defined within the engine body 124 through which the introduced water travels around to remove the heat of the engine body 124.

The engine 32 also preferably includes a lubrication system. A closed-loop type system preferably is employed in the illustrated embodiment. The lubrication system comprises a lubricant tank defining a reservoir cavity, which preferably is positioned within the driveshaft housing 54. An oil pump (not shown) is provided at a desired location, such as atop the driveshaft housing 54, to pressurize the lubricant oil in the reservoir cavity and to pass the lubricant oil through a suction pipe toward certain engine portions, which desirably are lubricated, through lubricant delivery passages. The engine portions that need lubrication include, for example, the crankshaft bearings (not shown), the connecting rods 120 and the pistons 106. For example, portions 214 of the delivery passages (FIG. 2) are defined in the crankshaft 118. Lubricant return passages (not shown) also are provided to return the oil to the lubricant tank for re-circulation.

A flywheel assembly 216 (FIG. 2) preferably is positioned at an upper portion of the crankshaft 118 and is mounted for rotation with the crankshaft 118. The flywheel assembly 216 comprises a flywheel magneto or alternator. Electric power generated by the flywheel magneto is accumulated in a battery 500 (FIG. 1) and is supplied to various electrical components such as the fuel injection system, the ignition system and the ECU 201 (FIG. 8).

The battery 500 preferably is disposed on a hull of the watercraft 40. The electric power accumulated in the battery 500 can also be supplied to various accessories 502 such as, for example, lighting implements 504 and a net winch 506. Because the accessories 502 can draw relatively large loads from the battery 500, an output voltage of the battery 500 can temporarily significantly drop during an operation of the accessories 502.

A protective cover 218, which preferably is made of plastic, extends over majority of the top surface of the engine 32 and preferably covers the portion that includes the fly wheel assembly 216 and the camshaft drive mechanism 186. The protective cover 218 preferably has a rib 219 (FIG. 4) that reduces or eliminates the amount of air flowing directly toward the engine portion that has the air induction system 126, i.e., to the portion on the starboard side. The protective cover 218 also preferably has a rib 220 (FIG. 2) that substantially or completely inhibits air from flowing directly toward a front portion of the engine body 124. The ribs 219, 222 advantageously help direct the airflow around the engine body 124 to cool the engine body 124. As seen in FIG. 2, a bottom portion, at least in part, of the protective cover 218 desirably is left open to allow heat to radiate from the engine 32.

With reference again to FIG. 1, the driveshaft housing 54 depends from the power head 50 to support a driveshaft 222 which is coupled with the crankshaft 118 and which extends generally vertically through the driveshaft housing 54. The driveshaft 222 is journaled for rotation and is driven by the crankshaft 118. The driveshaft housing 54 preferably defines an internal section of the exhaust system that leads the majority of exhaust gases to the lower unit 56. An idle discharge section is branched off from the internal section to discharge idle exhaust gases directly out to the atmosphere through a discharge port that is formed on a rear surface of the driveshaft housing 54 in idle speed of the engine 32. The driveshaft 222 preferably drives the oil pump.

With continued reference to FIG. 1, the lower unit 56 depends from the driveshaft housing 54 and supports a propulsion shaft 226 that is driven by the driveshaft 222. The propulsion shaft 226 extends generally horizontally through the lower unit 56 and is journaled for rotation. The propulsion device 41 is attached to the propulsion shaft 226. In the illustrated arrangement, the propulsion device includes a propeller 228 that is affixed to an outer end of the propulsion shaft 226. The propulsion device, however, can take the form of a dual counter-rotating system, a hydrodynamic jet, or any of a number of other suitable propulsion devices.

A transmission 232 preferably is provided between the driveshaft 222 and the propulsion shaft 226, which lie generally normal to each other (i.e., at a 90° shaft angle) to couple together the two shafts 222, 226 by bevel gears. The outboard motor 30 has a clutch mechanism that allows the transmission 232 to change the rotational direction of the propeller 228 among forward, neutral or reverse.

The lower unit 56 also defines an internal section of the exhaust system that is connected with the internal section of the driveshaft housing 54. At engine speeds above idle, the exhaust gases generally are discharged to the body of water surrounding the outboard motor 30 through the internal sections and then through a discharge section defined within the hub of the propeller 228.

VVT Mechanism

With continued reference to FIGS. 2–5 and with additional reference to FIGS. 6 and 7, a VVT mechanism 240 is described below.

The VVT mechanism 240 preferably is configured to adjust the intake camshaft 172 to varied angular positions between two limit angular positions, i.e., a fully advanced angular position and a fully retarded angular position, relative to an angular position of the crankshaft. At the fully advanced angular position, the intake camshaft 172 opens and closes the intake valves 134 at an advanced timing. At the fully retarded angular position, the intake camshaft 172 opens and closes the intake valves 134 at a retarded timing.

The VVT mechanism 240 preferably is hydraulically operated and thus comprises an adjusting section 242, a fluid supply and discharge section 244 and a control section 246. The adjusting section 242 sets the intake camshaft 172 to the certain angular position in response to a volume of working fluid that is allotted to two spaces of the adjusting section 242. The fluid supply and discharge section 244 preferably supplies a portion of the lubricant, which is used primarily for the lubrication system, to the adjusting section 242 as the working fluid. The control section 246 selects the rate or amount of the fluid directed to the adjusting section 242 under control of the ECU 201 (FIG. 8).

The adjusting section 242 preferably includes an outer housing 250 and an inner rotor 252. The outer housing 250 is affixed to the intake driven sprocket 188 by three bolts 254 in the illustrated arrangement and preferably forms three chambers 256 between the three bolts 254. Any other suitable fastening technique and any suitable number of chambers 256 can be used. The inner rotor 252 is affixed atop the intake camshaft 172 by a bolt 258 and has three vanes 260 pivotally placed within the respective chambers 256 of the housing 250. The number of vanes 260 can be varied and the inner rotor 252 can be attached to the camshaft 172 in any suitable manners.

Figure 6:
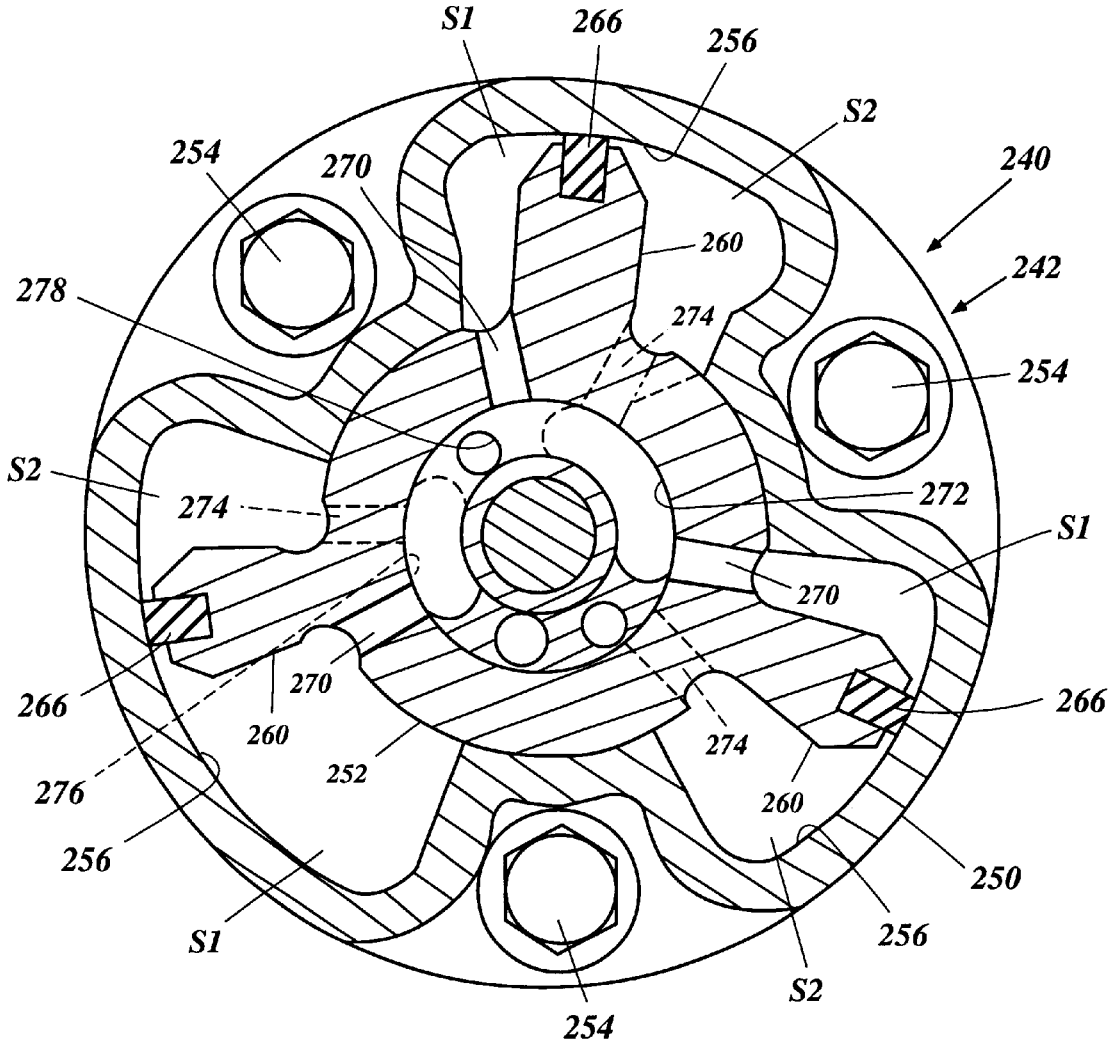
FIG. 6 is a sectional view of the VVT mechanism taken along the line 6—6 of FIG. 5.

With particular reference to FIG. 6, the vanes 260 preferably extend radially and are spaced apart from each other with an angle of about 120 degrees. The two sides of the vane 260, together with the walls of each chamber 256 define a first space SI and a second space S2 respectively. Seal members 266 carried by the respective vanes 260 and abutting on an inner surface of the housing 250 separate the first and second spaces S1, S2 from each other.

The respective first spaces S1 communicate with one another through respective pathways 270 and a passage 272 that is formed around the bolt 258. The respective second spaces S2 communicate with one another through respective pathways 274 and a passage 276 that is also formed around the bolt 258. The passages 272, 276 generally are configured as an incomplete circular shape and can be offset from one another (e.g., 60 degrees offset may be used). A pathway 278 extends from the passage 272 to a bottom portion of the rotor 252 through ends of the passage 276. A cover member 280 is affixed to the outer housing 250 by screws 282 to cover the bolt 258. The passages 272, 276 allow fluid communication with the respective pathways 270, 274, 278 during rotation of the camshaft 172.

With particular reference to FIGS. 2 and 5, the fluid supply and discharge section 244 preferably includes a supply passage 284 and two delivery passages 286, 288. The supply passage 284 and the delivery passages 286, 288 communicate with one another through the control section 246. The supply passage 284 preferably has a passage portion 284*a* (FIGS. 2 and 5) defined in the cylinder head member 108 and a passage portion 284*b* (FIG. 2) defined in the bearing cap 176. The passage portion 284*a* is connected to the lubrication system, while the passage portion 284*b* is connected to the control section 246. Thus, the lubricant oil of the lubrication system is supplied to the control section 246 through the fluid supply and discharge passage 284.

The supply passage 284 communicates with the lubrication system so that a portion of the lubricant oil is supplied to this VVT mechanism 240 through the passage portions 284*a*, 284*b*. Because the passage portion 284*a* is formed by a drilling process in the illustrated embodiment, a closure member 290 closes one end of the passage portion 284*a*. The passage portion 284*b* is branched off to a camshaft lubrication passage 284*c* (FIG. 5) which delivers lubricant for lubrication of a journal of the camshaft 172.

The delivery passages 286, 288 preferably are defined in a top portion of the camshaft 172 and the bearing cap 176. A portion of the delivery passage 286 formed in the camshaft 172 includes a pathway 292 that extends generally vertically and that communicates with the pathway 278 that communicates with the passage 272 of the first space S1. The pathway 292 also communicates with a passage 294 that is formed in the camshaft 172. A portion of the delivery passage 288 formed in the camshaft 172, in turn, includes a pathway 296 that extends generally vertically and communicates with the passage 276 of the second space S2. The pathway 296 also communicates with a passage 298 that is formed in the camshaft 172. A portion of the delivery passage 286 formed in the bearing cap 176 includes a pathway 300 that extends generally vertically and generally horizontally to communicate with the passage 294, while a portion of the delivery passage 288 formed in the bearing cap 176 includes a pathway 302 that extends generally vertically and generally horizontally to communicate with the passage 298. The other ends of the pathways 300, 302 communicate with a common chamber 304 formed in the control section 246 through ports 306, 308, respectively.

A seal member 310 (FIG. 5) is inserted between the cylinder head member 108, the camshaft 172 and the bearing cap 176 to inhibit the lubricant from leaking out. It should be noted that FIGS. 5 and 7 illustrate the delivery passages 286, 288 in a schematic fashion. The passages 286, 288 do not merge together.

Figure 7:
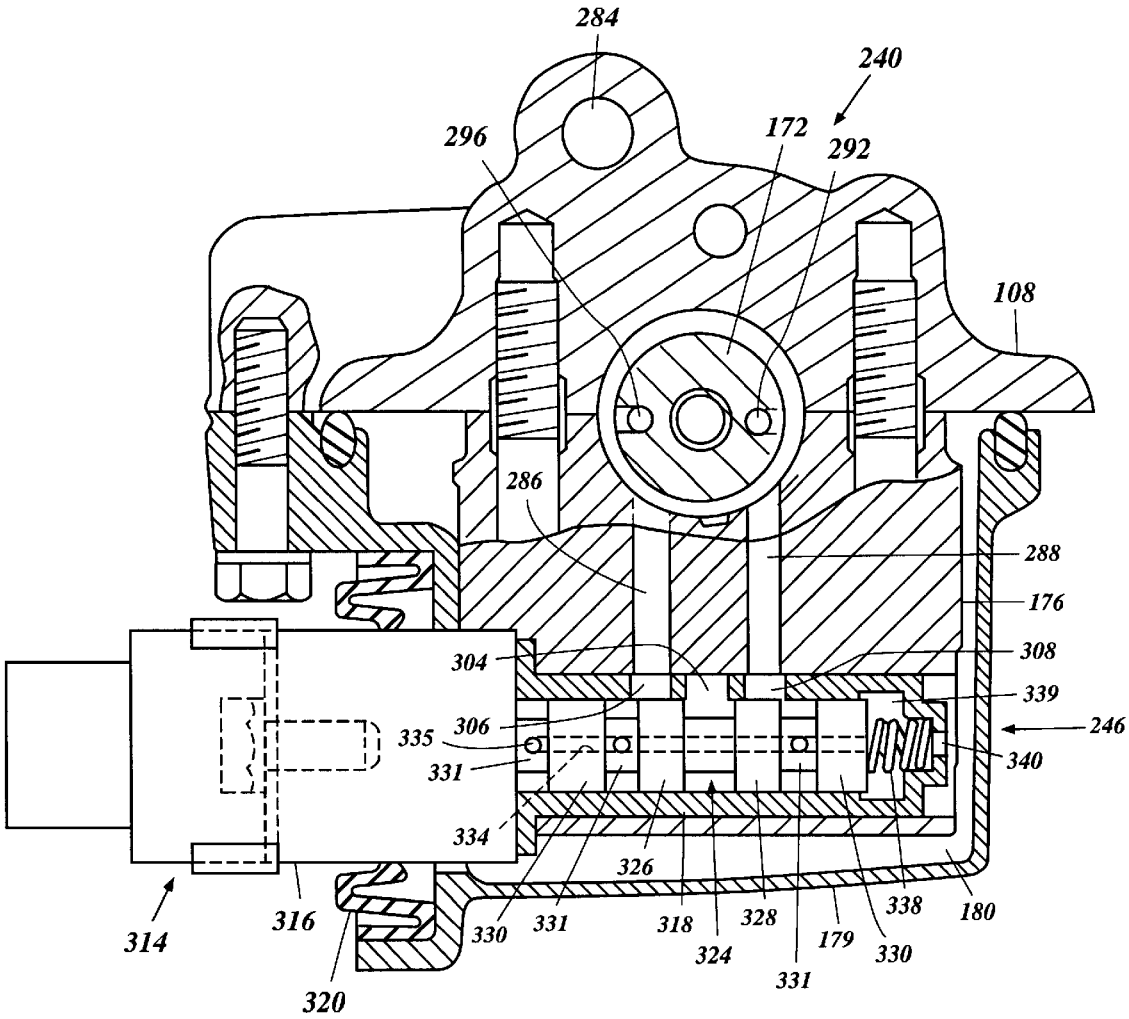
FIG. 7 is a sectional view of the VVT mechanism taken partially along the line 7—7 of FIG. 5.

The control section 246 preferably includes an oil control valve (OCV) 314 (FIG. 7). The OCV 314 comprises a housing section 316 and a cylinder section 318. Both the housing and cylinder sections 316, 318 preferably are received in the bearing cap 176. Because the sections 316, 318 together extend through a hole of the camshaft cover 179, a bellow 320 made of rubber is provided between the housing section 316 and the camshaft cover 179 to close and seal the through-hole.

The cylinder section 318 defines the common chamber 304 that communicates with the supply passage 284 and the delivery passages 286, 288. The housing section 316 preferably encloses a solenoid type actuator (not shown), although other actuators of course are available. The solenoid actuator is connected to the battery 500 so that the electric power is supplied to the solenoid actuator. A rod 324 extends into the common chamber 304 from the actuator and is axially movable therein. The rod 324 has a pair of valves 326, 328 and a pair of guide portions 330. The valves 326, 328 and the guide portions 330 have an outer diameter that is larger than an outer diameter of the remainder portions 331 of the rod 324 and is generally equal to an inner diameter of the cylinder section 318. The rod 324 defines an internal passage 334 extending through the rod 324 and apertures 335 communicating with the passage 334 and the common chamber 304 to allow free flow of the lubricant in the chamber 304. A coil spring 338 is retained in a spring retaining space 339 at an end of the cylinder 318 opposite to the housing section 316 to urge the rod 324 toward the actuator. The lubricant can be drained to the camshaft chamber 180 through the spring retaining chamber 339 and a drain hole 340.

The solenoid actuator actuates the rod 324 under control of the ECU 201 (FIG. 8) so that the rod 324 can take any positions in the chamber 304. More specifically, the solenoid pushes the rod 324 toward the certain position in compliance with commands of the ECU 201. If a certain position designated by the ECU 201 is closer to the solenoid actuator than the present position, then the solenoid actuator does not actuate the rod 324 and the coil spring 338 pushes back the rod 324 to the desired position. Otherwise, the solenoid actuator can be configured to pull the rod 324 back to the position.

The valve 326 can close the port 306 entirely or partially, while the valve 328 can close the port 308 entirely or partially. Each rate of the closing degree determines an amount of the lubricant that is allotted to each delivery passage 286, 288 and to each space S1, S2 in the adjusting section 242. Each allotted rate of the lubricant to each space S1, S2 then determines an angular position of the camshaft 172. If more lubricant is allotted to the first space S1 than to the second space S2, the camshaft 172 is set closer to the fully advanced position, and vise versa.

The oil pump pressurizes the lubricant oil to the supply passage 284 and further to the common chamber 304 of the cylinder 318. Meanwhile, the ECU 201 (FIG. 8) controls the solenoid to place the rod 324 at a position where the respective rates of the closing degrees of the valves 326, 328 are determined so that a corresponding angular position of the camshaft 172 is determined. Preferably, a drain is provided to allow the lubricant oil to drain from the space that is being evacuated while pressurized lubricant oil flows into the opposing space.

In one mode of operation, for example, the lubricant oil is fed to the common chamber 304 of the cylinder 318. Thus, the common chamber 304 has a positive pressure. To move the camshaft 172 in a first direction relative to the input sprocket 188, the common chamber 304 is linked with the delivery passage 286 while the other of the delivery passage 288 is linked to a drain. Thus, pressurized oil will flow into the first space S1 while oil will be displaced from the second space S2. The displaced oil flows to a drain and returns to the lubrication system. Once the desired movement has occurred, the rod 324 is returned to a neutral position in which the common chamber 304 is no longer communicating with either of the delivery passages 286, 288. Additionally, in the neutral position, neither of the delivery passages 286, 288 communicates with the drain in one particularly advantageous arrangement. Of course, by varying the placement and size of the seals, a constant flow can be produced from supply to drain while the rod 324 is in a neutral position. Also, a constant flow into the delivery lines also can be constructed. In the illustrated arrangement, however, no flow preferably occurs with the system in a neutral position.

The engine and the VVT mechanism are disclosed in, for example, a co-pending U.S. application filed Jun. 11, 2001, titled FOUR-CYCLE ENGINE FOR MARINE DRIVE, which Ser. No. is 09/878,323, the entire contents of which is hereby expressly incorporated by reference.

Control System

With reference to FIG. 8, a valve timing control system of the VVT mechanism 40 using the ECU 201 is described below.

FIG. 8 schematically illustrates the engine 32. The illustrated ECU 201 controls the valve timing of the intake valves 134 by changing the angular positions of the intake camshaft 172 through the VVT mechanism 40. The ECU 201 also controls the fuel injectors 198 using the fuel injection control unit 202. The ECU 201 is connected to the OCV 314 as the control section 246 of the VVT mechanism 40 and the fuel injectors through control signal lines.

In order to control the VVT mechanism 40 and the fuel injectors 198, the ECU 201 can employ various sensors which sense operational conditions of the engine 32 and/or the outboard motor 30. In the present system, the ECU 201 uses a camshaft angle position sensor 350, a crankshaft angle position sensor 352, a throttle position sensor (or throttle valve opening degree sensor) 354 and an intake pressure sensor 356. The ECU 201 is connected to the sensors 350, 352, 354, 356 through sensor signal lines.

The camshaft angle position sensor 350 is associated with the intake camshaft 172 to sense an angular position of the intake camshaft 172 and sends an actual camshaft angular position signal to the ECU 201 through the signal line. The crankshaft angle position sensor 352 is associated with the crankshaft 118 to sense an angular position of the crankshaft 118 and sends a crankshaft angular position signal to the ECU 201 through the signal line. Both the camshaft angle position sensor 350 and the crankshaft angle position sensor 352 in the present system generate pulses as the respective signals. The pulse of the camshaft position sensor 350 can give an actual angular position of the camshaft 172. The crankshaft position signal together with the camshaft position signal allows the ECU 201 to accurately determine the position of the camshaft 172 in relation to the crankshaft 118.

The throttle position sensor 354 preferably is disposed atop the valve shaft 154 to sense an angular position between the open and closed angular positions of the throttle valves 152 and sends a throttle valve opening degree signal to the ECU 201 through the signal line.

The intake sensor 356 preferably is disposed either within one of the intake passages 130 or within the plenum chamber 132 to sense an intake pressure therein. Because the respective intake passages 130 are formed such that each generally is the same size as the others, and because the plenum chamber 132 collects a large volume of air that is supplied to each of the intake passages 130, every passage 130 has substantially equal pressure and a signal of the intake pressure sensor 356 thus can represent a condition of the respective pressure. Thus, it should be appreciated that a single pressure sensor or multiple pressure sensors can be used.

The throttle valve position sensor 354 and the intake pressure sensor 356 preferably are selected from a type of sensor that indirectly senses an amount of air in the induction system. Another type of sensor that directly senses the air amount, of course, can be applicable. For example, moving vane types, heat wire types and Karman Vortex types of air flow meters also can be used.

The operator's demand or engine load, as determined by the throttle opening degree, is sensed by the throttle position sensor 354. Generally, in proportion to the change of the throttle opening degree, the intake air pressure also varies and is sensed by the intake pressure sensor 356. The throttle valve 152 (FIG. 3) is opened when the operator operates the throttle lever to increase the speed of the watercraft 40. The intake pressure almost simultaneously decreases at this moment.

The engine load can also increase when the associated watercraft 40 advances against wind. In this situation, the operator also operates the throttle lever to recover the speed that may be lost. Therefore, as used in this description, the term "acceleration" means not only the acceleration in the narrow sense but also the recovery operation of speed by the operator in a broad sense. Also, the term "sudden acceleration" means the sudden acceleration in the narrow sense and a quick recovery operation of the speed by the operator in a broad sense.

The signal lines preferably are configured with hard-wires or wire-harnesses. The signals can be sent through emitter and detector pairs, infrared radiation, radio waves or the like.

The type of signal and the type of connection can be varied between sensors or the same type can be used with all sensors which are described above and will be described below.

Signals from other sensors or control signals also can be used for the control by the ECU 201. In the present control system, various sensors other than the sensors described above are also provided to sense the operational condition of the engine 32 and/or the outboard motor 30. For example, an oil pressure sensor 360, a water temperature sensor 362, an engine body temperature sensor 364, a knock sensor 366, a transmission position sensor 368, an oxygen sensor 370 for determining a current air/fuel ratio, and an intake air temperature sensor 372 are provided in the present control system. The sensors except for the transmission position sensor 368 can sense the operational conditions of the engine 32 and send signals to the ECU 201 through respective sensor signal lines. The transmission position sensor 368 senses whether the transmission 232 (FIG. 1) is placed at the forward, neutral or reverse position and sends a transmission position signal to the ECU 201 through the signal line. An ignition control signal 374 and a fuel injection control signal 376 and an AAD control signal 378 are also used by the ECU 201 for control of the spark plugs 203 (FIG. 2), the fuel injectors 198 and the AA) (not shown), respectively. The foregoing sensors 350–372 and the control signals 374–378, in a broad sense, define sensors 380 that sense operational conditions of the engine and/or the outboard motor.

The ECU 201 can be designed as a feedback control device using the signals of the sensors. The ECU 201 preferably has a central processing unit (CPU) and at least one storage unit which holds various control maps including data regarding parameters such as, for example, the engine speed, the throttle valve position and the intake pressure (and/or an amount of intake air) to determine an optimum control condition at every moment and then controls the VVT mechanism 40, the fuel injectors 198 and other actuators in accordance with the determined control condition.

The ECU 201 can include the fuel injection control unit or module 202 as a hard-wired feed back control circuit, a dedicated processor and memory configured to run one or a plurality of control routines, or a general purpose processor and memory configured to run one or a plurality of control routines. Other units, described below, also are included in the ECU 201 as hard-wired feed back control circuits, a dedicated processors and memory units configured to run one or a plurality of control routines, or general purpose processors and memory units configured to run one or a plurality of control routines. However, for easier understanding of the reader, the units will be described as if they were discriminate and substantial units. The illustrated fuel injection control unit 202 controls the fuel injectors 198 using at least the throttle opening degree signal from the throttle position sensor 354 and the intake pressure signal from the intake pressure sensor 356.

The ECU 201 preferably comprises, other than the fuel injection control unit 202, an actual camshaft angular position calculation (ACAPC) unit 384, an engine speed calculation unit 386, a target camshaft angular position calculation (TCAPC) unit 388, and a control value calculation unit 390. The TCAPC unit 388 and the control value calculation unit 390 together form an OCV control section 392 in this ECU configuration.

The ACAPC unit 384 preferably receives the actual camshaft angular position signal from the camshaft angle position sensor 350 and the crankshaft angular position signal, which gives two possible ranges of camshaft angular position, from the crankshaft angle position sensor 352. The ACAPC unit 384 then calculates a deviation value which indicates how much the actual camshaft angular position deviates within the two possible ranges of camshaft angular position.

The engine speed calculation unit 386 receives the crankshaft angular position signal from the crankshaft angle position sensor 352 and calculates an engine speed using the signal versus time.

The TCAPC unit 388 receives the deviation value from the ACAPC unit 384, the engine speed from the engine speed calculation unit 386 and at least one of the throttle valve opening degree signal from the throttle valve position sensor 354 and the intake pressure signal from the intake pressure sensor 356. The TCAPC unit 388 then calculates a target camshaft angular position based upon the deviation value, the engine speed and at least one of the throttle valve opening degree signal and the intake pressure signal.

The control value calculation unit 390 receives the target camshaft angular position from the TCAPC unit 388 and calculates a control value of the OCV 314 of the VVT mechanism 40. That is, the control value calculation unit 390 determines how much oil is delivered to either the space S1 or the space S2 of the adjusting section 242 of the VVT mechanism 40 based upon the target camshaft angular position.

Under a normal running condition and an ordinary acceleration condition (i.e., not sudden acceleration condition), the ECU 201 preferably uses either a combination of the throttle valve opening degree signal with the engine speed signal ($\alpha$-N method) or a combination of the intake pressure signal with the engine speed signal (D-j method) to calculate the target camshaft angular position. Otherwise, the ECU 201 can use a mixed combination of the $\alpha$-N method and the D-j method under the normal running condition or the ordinary acceleration condition. The $\alpha$-N method, the D-j method and the mixed combination thereof are disclosed in, for example, a co-pending U.S. application filed Feb. 14, 2002, titled CONTROL SYSTEM FOR MARINE ENGINE, which Ser. No. is 10/078,275, the entire contents of which is hereby expressly incorporated by reference. An air amount signal sensed by the air flow meter noted above can be applied additionally or instead either the intake pressure signal or the throttle opening degree signal.

Under sudden acceleration condition, the illustrated ECU 201 preferably uses using only the throttle opening degree signal. That is, the ECU 201 determines, at least prior to controlling the OCV 314 with the OCV control section 392, whether the operator wishes sudden acceleration or not. The sudden acceleration condition preferably is determined when a change rate of the throttle opening degree signal, a change rate of the intake pressure signal or a change rate of the engine speed calculated by the engine speed calculation unit 386 becomes greater than a predetermined magnitude. A change rate of the air amount signal also can be used to determine the sudden acceleration condition. Theoretically, the predetermined magnitude can be set at any magnitude larger than zero.

FIG. 8 also illustrates the battery 500 that supplies electric power to the solenoid actuator of the OCV 314, the tilt and trim adjustment system 47 and the accessories 502.

Figure 9:
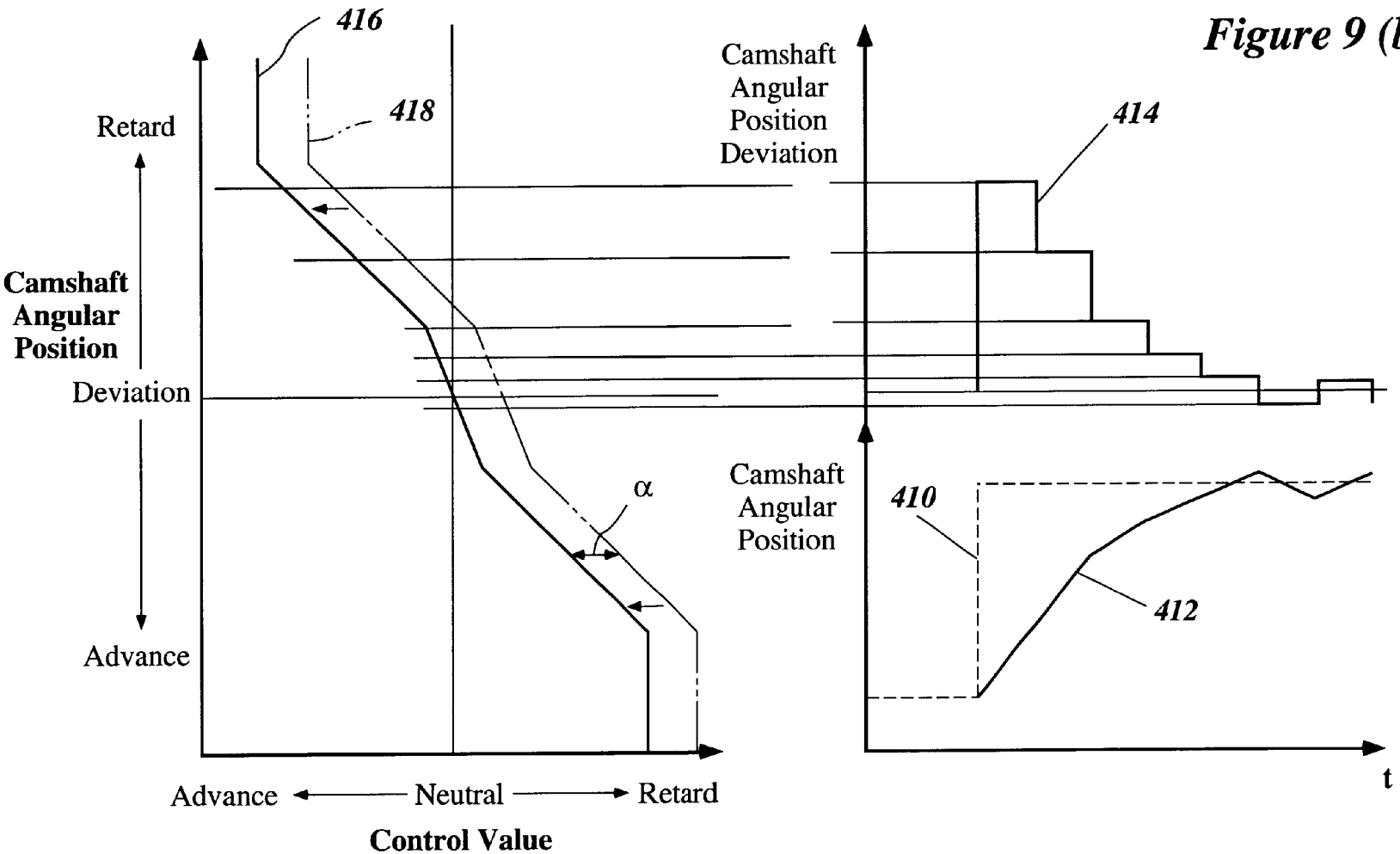
FIGS. 9(*a*), 9(*b*) and 9(*c*) are graphical views illustrating camshaft angular positions, a camshaft angular deviation between a target camshaft angular position and an actual camshaft angular position, and a control characteristic, respectively, all of which relate with each other. The dotted line of FIG. 9(*a*) illustrates the target camshaft angular position and the solid line of FIG. 9(*a*) illustrates the actual camshaft angular position. The solid line of FIG. 9(*c*) illustrates the control characteristic in an original position where no voltage drop occurs in the electrical system. The phantom line of FIG. 9(*c*) illustrates the same control characteristic deviated from the original position where a voltage drop occurs in the electrical system.

FIGS. 9(*a*), (*b*), (*c*) illustrate an exemplary control conducted by the ECU 201.

FIG. 9(*a*) shows a target camshaft angular position 410 calculated by the TCAPC unit 388 and an actual camshaft angular position 412 sensed by the camshaft angle position sensor 350, both versus time. When the target camshaft angular position 410 is going to move to an advanced position, the adjustment of the camshaft 172 is slower than the target timing 410. Thus, actual camshaft angular position 412 is initially retarded relative to the target camshaft angular position 410 until it catches up with the target camshaft angular position 410 as shown in FIG. 9(*a*). Although not illustrated, when the target camshaft angular position 410 is going to move to a retarded position, the actual camshaft angular position 412 is initially advanced relative to the target camshaft angular position 410 and then catches up with the target camshaft angular position 410.

FIG. 9(*b*) illustrates a camshaft angular position deviation 414 between the target and actual camshaft angular positions 410, 412 versus time. The deviation 414 decreases as the actual camshaft angular position 412 approaches the target camshaft angular position 410.

FIG. 9(*c*) illustrates a control characteristic 416. The control characteristic 416 preferably is stored as a control map. The vertical axis represents the camshaft angular deviation. The horizontal axis represents the control value of the control value calculation unit 390. Under a normal running condition of the engine 32, if the actual camshaft angular position 412 is retarded relative to the target camshaft angular position 410 as shown in FIGS. 9(*a*), (*b*), thereby generating a deviation amount, the control value according to the characteristic 416 is advanced relative to a neutral position. If the actual camshaft angular position 412 is advanced relative to the target camshaft angular position 410, thereby generating a deviation amount, the control value is retarded relative to the neutral position.

According to the characteristic 416, the greater the deviation amount, the greater the control amount, and thus the faster the VVT mechanism will adjust the position of the camshaft 172 towards the target position.

If the operator operates either the tilt system 47 or the accessory 502, the voltage of the electrical system, e.g., the voltage across the battery 500, can drop significantly. When the voltage drop occurs, the voltage applied to the solenoid also drops. Thus, solenoid does not move the rod to the correct position.

In the illustrated embodiment, the spring 338 biases the rod 324 toward a retard position, i.e., toward a position in which the valve member 328 allows the supply port 304 to communicate with the supply passage 288, and in which the valve member 326 blocks communication between the supply port 304 and the supply passage 388. In a neutral state, a sufficient voltage is applied to the solenoid such that the rod 324 blocks a flow of oil from the supply port 304 to the passages 286, 288. However, during a voltage drop, the force of the spring 338 overcomes the force applied by the solenoid, thereby moving the rod toward a retard position. The value $\alpha$ represents difference between the correct control amount and the erroneous control amount created by the voltage drop. Optionally, the spring 338 could be configured to bias the rod 324 to the neutral position, or to the advance position. With these configurations, the corresponding characteristics 418 illustrated in FIG. 9(*c*) would have different shapes.

In order to inhibit the inaccurate control from being conducted, the present system further comprises a tilt operation sensor 510, accessory operation sensors 512 and a control value adjustment unit 514 as shown in FIG. 8. The tilt operation sensor 510 and the accessory operation sensors 512 are connected to the control value adjustment unit 514 through sensor signal lines, respectively.

The tilt operation sensor 510 preferably is a sensor configured to detect a change of voltage between terminals of an operation switch that makes the electric motor of the tilt system 47 start. The tilt operation sensor 510 senses a voltage drop between the terminals at a moment such that the operation switch is closed and sends a tilt operation signal to the ECU 201. Alternatively, a proximity sensor comprising a magnet and a reed switch can be used. The proximity sensor is a sensor that can sense a relative movement of a plurality of members. One of the magnet and the reed switch is disposed on the operation switch or other movable member that moves with the operation of the tilt system 47 and the other one is disposed on a fixed member. Otherwise, a switch position sensor is also applicable. If the tilt cylinder unit 48 and the trim cylinder units 49 are separately controlled in some arrangements, a trim operation sensor can be provided other than the tilt operation sensor 510.

The accessory operation sensors 512 preferably are sensors similar to the tilt operation sensor. That is, each sensor is configured to detect a change of voltage between terminals of an operation switch that activates the associated accessory 502. The accessory sensor 512 senses a voltage drop between the terminals at a moment such that the operation switch is closed and sends an accessory operation signal to the ECU 201. Otherwise, proximity sensors or switch position sensors can also be used in a similar manner described above.

When the tilt system 47 is operated, the tilt operation sensor 510 sends a tilt operation signal to the control value adjustment unit 514 through the signal line. In a similar manner, when at least one of the accessories 502 is operated, the associated accessory operation sensor 512 sends an accessory operation signal to the control value adjustment unit 514 through the signal line. The control value adjustment unit 514 then adjusts the control value of the control value calculation unit 390 to advance the camshaft angular position with a fixed angular amount $\alpha$ (FIG. 9). In other words, the control value adjustment unit 514 moves the phantom control characteristic 418 back to the control characteristic 416. The fixed angular amount a can be obtained through experimentation with each application in which the engine 32 is used.

The ECU 201 can be configured to provide the adjustment by the control value adjustment unit 514 when either the tilt system 47 or one of the accessories 502 is operated by the operator. The adjustment thus is made slightly before or at least simultaneously with the beginning of the corresponding voltage drop. The illustrated ECU 201 thus can control the VVT mechanism 40 with a more optimum control characteristic 416.

This is particularly useful because the trim is likely to be adjusted during acceleration, the same time the VVT mechanism will be driven. The adjustment control by the illustrated ECU thus is quite suitable to the acceleration operation because of no substantial delay in response with the operation.

Of course, the foregoing description is that of preferred controls having certain features, aspects and advantages in accordance with the present invention. For instance, the adjustment control characteristic can be calculated by the ECU with a previously provided functional equation rather than being previously provided as a control map. The adjustment made by the control value adjustment unit in this alternative is just adding a fixed amount to the calculated value. Accordingly, various changes and modifications also may be made to the above-described controls without departing from the spirit and scope of the invention, as defined by the claims.

What is claimed is:

1. An internal combustion engine comprising an engine body, a movable member movable relative to the engine body, the engine body and the movable member together defining a combustion chamber, the engine body defining intake and exhaust ports communicating with the combustion chamber, an air induction system communicating with the combustion chamber through the intake port, an exhaust system communicating with the combustion chamber through the exhaust port, an intake valve arranged to move between an open position and a closed position of the intake port, an exhaust valve arranged to move between an open position and a closed position of the exhaust port, a valve actuator arranged to actuate one of the intake valve and the exhaust valve, a valve actuator adjustment mechanism including an electric actuator configured to adjust an actuating timing of the valve actuator at which the valve actuator actuates the intake valve or the exhaust valve, a control module configured to control the electric actuator based upon a control characteristic, a power supply configured to provide power to the electric actuator and a second electrical component, and at least one sensor configured to detect when the second electrical component is operated, the control module being configured to adjust the control characteristic based on the power provided to the second electrical component when the second electrical component is operated.

2. The engine as set forth in claim 1, wherein the adjustment mechanism additionally comprises an adjusting section configured to adjust a position of the valve actuator, a fluid supply and discharge section configured to supply a working fluid to the adjusting section and to discharge the working fluid from the adjusting section, the electric actuator being configured to adjust at least an amount of the working fluid supplied to the adjusting section.

3. The engine as set forth in claim 2, wherein the electric actuator is configured to drive a valve member to move between a supply position and a non-supply position of the working fluid.

4. The engine as set forth in claim 1, additionally comprising a crankshaft journalled for rotation at least partially within the engine body, wherein the valve actuator includes a camshaft journaled on the engine body for rotation, the camshaft defining a cam lobe actuating the intake or exhaust valve, the adjustment mechanism being configured to adjust an angular position of the camshaft relative to the crankshaft.

5. The internal combustion engine of claim 1, wherein the control module is configured to determine a target actuating timing, the control module is configured to control the change mechanism to reduce the difference between the actuating timing and the target actuating timing of the valve actuator.

6. The internal combustion engine of claim 1, wherein the control module is configured to adjust the control characteristic to compensate for the power provided to the second electrical component to achieve a desired actuating timing.

7. An internal combustion engine comprising an engine body, a movable member movable relative to the engine body, the engine body and the movable member together defining a combustion chamber, the engine body defining intake and exhaust ports communicating with the combustion chamber, an air induction system communicating with the combustion chamber through the intake port, an exhaust system communicating with the combustion chamber through the exhaust port, an intake valve arranged to move between an open position and a closed position of the intake port, an exhaust valve arranged to move between an open position and a closed position of the exhaust port, a valve actuator arranged to actuate one of the intake valve and the exhaust valve, a valve actuator adjustment mechanism including an electric actuator configured to adjust an actuating timing of the valve actuator at which the valve actuator actuates the intake valve or the exhaust valve, a control module configured to control the electric actuator based upon a control characteristic, at least one sensor configured to detect when a second electrical component is operated, the control module being configured to adjust the control characteristic when the second electrical component is operated, and a timing sensor configured to detect an actual actuating timing of the valve actuator and to send an actual timing signal to the control module, the control module being configured to determine a target timing of the valve actuator, the control module being configured to control the adjustment mechanism to advance the actual timing when the actual timing is retarded relative to the target change timing, the control module being configured to control the change mechanism to further advance the actual timing when the second electrical component is operated.

8. An internal combustion engine comprising an engine body, a movable member movable relative to the engine body, the engine body and the movable member together defining a combustion chamber, the engine body defining intake and exhaust ports communicating with the combustion chamber, an air induction system communicating with the combustion chamber through the intake port, an exhaust system communicating with the combustion chamber through the exhaust port, an intake valve arranged to move between an open position and a closed position of the intake port, an exhaust valve arranged to move between an open position and a closed position of the exhaust port, a valve actuator arranged to actuate one of the intake valve and the exhaust valve, a valve actuator adjustment mechanism including an electric actuator configured to adjust an actuating timing of the valve actuator at which the valve actuator actuates the intake valve or the exhaust valve, a control module configured to control the electric actuator based upon a control characteristic, at least one sensor configured to detect when a second electrical component is operated, the control module being configured to adjust the control characteristic when the second electrical component is operated, wherein the control module is configured to control the change mechanism to retard an actual timing when the actual timing is advanced relative to a target timing, and the control module being configured to control the change mechanism to further advance the actual timing when the second electrical component is operated.

9. An internal combustion engine comprising an engine body, a movable member movable relative to the engine body, the engine body and the movable member together defining a combustion chamber, the engine body defining intake and exhaust ports communicating with the combustion chamber, an air induction system communicating with the combustion chamber through the intake port, an exhaust system communicating with the combustion chamber through the exhaust port, an intake valve arranged to move between an open position and a closed position of the intake port, an exhaust valve arranged to move between an open position and a closed position of the exhaust port, a valve actuator arranged to actuate one of the intake valve and the exhaust valve, a valve actuator adjustment mechanism including an electric actuator configured to adjust an actuating timing of the valve actuator at which the valve actuator actuates the intake valve or the exhaust valve, a control module configured to control the electric actuator based upon a control characteristic, at least one sensor configured to detect when a second electrical component is operated, the control module being configured to adjust the control characteristic when the second electrical component is operated, and wherein the second electrical component includes an accessory adapted to be operated for either a marine drive powered by the engine or a watercraft powered by the engine.

10. An outboard motor comprising a housing unit, an internal combustion engine supported by the housing unit, a bracket assembly adapted to mount the housing unit on an associated watercraft for a tilt movement about a generally horizontally extending tilt axis, and a tilt mechanism configured to tilt the housing unit about the tilt axis, the tilt mechanism including an electrical component, the engine comprising an engine body, a movable member movable relative to the engine body, the engine body and the movable member together defining a combustion chamber, the engine body defining intake and exhaust ports communicating with the combustion chamber, an air induction system communicating with the combustion chamber through the intake port, an exhaust system communicating with the combustion chamber through the exhaust port, an intake valve arranged to move between an open position and a closed position of the intake port, an exhaust valve arranged to move between an open position and a closed position of the exhaust port, a valve actuator configured to actuate either the intake valve or the exhaust valve, a hydraulic change mechanism configured to change an actuating timing of the valve actuator at which the valve actuator actuates the intake valve or the exhaust valve, the change mechanism including an electrically operable member varying a hydraulic flow in the change mechanism to change the actuating timing of the valve actuator, the electrically operable unit being adapted to be supplied with electric power from a power source, a control module configured to control the electrically operable member based upon a control characteristic, the electrical component adapted to be supplied with electric power from the power source, and a tilt sensor configured to sense when the electrical component is operated and to send a signal indicative that the electrical component is operating to the control module, the control module adjusting the control characteristic in accordance with the signal from the sensor.

11. The outboard motor as set forth in claim 10, wherein the tilt mechanism additionally includes a hydraulic cylinder unit, and a hydraulic pump configured to supply working fluid to the cylinder unit, the electric component includes an electric motor arranged to drive the hydraulic pump.

12. The outboard motor as set forth in claim 10, wherein the change mechanism additionally includes an adjusting section configured to adjust a position of the valve actuator, a fluid supply and discharge section configured to supply working fluid to the adjusting section and to discharge the working fluid from the adjusting section, the electrically operable unit being arranged to adjust at least an amount of the working fluid supplied to the adjusting section.

13. The outboard motor as set forth in claim 10, wherein the electrically operable unit includes a valve arranged to move between a supply position and a non-supply position of the working fluid, and a valve actuator configured to actuate the valve under control by the control module.

14. The outboard motor as set forth in claim 10 additionally comprising a timing sensor sensing an actual actuating timing of the valve actuator and sending an actual timing signal to the control module, the control module being configured to set a target change timing of the change mechanism, the control module being configured to control the change mechanism to advance the actual timing when the actual timing is behind the target change timing, and the control module being configured to control the change mechanism to further advance the actual timing when the signal is sent to the control module from the sensor.

15. The outboard motor as set forth in claim 14, wherein the control module is configured to control the change mechanism to retard the actual timing when the actual timing is ahead the target change timing, and the control module being configured to control the change mechanism to advance the actual timing when the electrical component operated signal is sent to the control module from the sensor.

16. A method for controlling an internal combustion engine including intake and exhaust valves, a valve actuator arranged to actuate the intake and exhaust valves, and a hydraulic change mechanism configured to change an actuating timing of the valve actuator at which the valve actuator actuates at least one of the intake valve and the exhaust valve, the method comprising changing the actuating timing based upon a control characteristic, supplying electric power to an electrically operable member of the change mechanism from a power source, sensing when an electrical component connected to the power source is operated to receive the electric power from the power source, and adjusting the control characteristic based on the amount of electrical power received by the electrical component.

17. A method for controlling an internal combustion engine including intake and exhaust valves, a valve actuator arranged to actuate the intake and exhaust valves, and a hydraulic change mechanism configured to change an actuating timing of the valve actuator at which the valve actuator actuates at least one of the intake valve and the exhaust valve, the method comprising changing the actuating timing based upon a control characteristic, supplying electric power to an electrically operable member of the change mechanism from a power source, sensing when an electrical component connected to the power source is operated to receive the electric power from the power source, adjusting the control characteristic when the electrical component is operated, sensing an actual actuating timing of the valve actuator, controlling the change mechanism to advance the actual timing when the sensed actual timing is behind a target timing, and controlling the change mechanism to further advance the actual timing when the electrical component is operated.

18. A method for controlling an internal combustion engine including intake and exhaust valves, a valve actuator arranged to actuate the intake and exhaust valves, and a hydraulic change mechanism configured to change an actuating timing of the valve actuator at which the valve actuator actuates at least one of the intake valve and the exhaust valve, the method comprising changing the actuating timing based upon a control characteristic, supplying electric power to an electrically operable member of the change mechanism from a power source, sensing when an electrical component connected to the power source is operated to receive the electric power from the power source, adjusting the control characteristic when the electrical component is operated, sensing an actual actuating timing of the valve actuator, controlling the change mechanism to retard the actual timing when the sensed actual timing advances than a target timing, and controlling the change mechanism to further advance the actual timing when the electrical component is operated.

19. A method for controlling an outboard motor having a tilt mechanism and an internal combustion engine, the engine including intake and exhaust valves, a valve actuator arranged to actuate the intake and exhaust valves, and a hydraulic change mechanism arranged to change an actuating timing of the valve actuator at which the valve actuator actuates at least one of the intake valve and the exhaust valve, the method comprising changing the actuating timing based upon a control characteristic, supplying electric power to an electrically operable member of the change mechanism from a power source, supplying electric power to an electrical component of the tilt mechanism from the power source, sensing the electrical component is operated to receive the electric power from the power source, and adjusting the control characteristic when the electrical component is operated.

20. The method as set forth in claim 19 additionally comprising sensing an actual actuating timing of the valve actuator, controlling the change mechanism to advance the actual timing when the sensed actual timing retards than a target timing, and controlling the change mechanism to further advance the actual timing when the electrical component is operated.

21. The method as set forth in claim 19 additionally comprising sensing an actual actuating timing of the valve actuator, controlling the change mechanism to retard the actual timing when the sensed actual timing advances than a target timing, and controlling the change mechanism to further advance the actual timing when the electrical component is operated.

22. An engine comprising an engine body, a shaft rotatably journalled for rotation at least partially within the engine body, at least one valve seat, at least one valve configured to move between an open position relative to the valve seat and a closed position relative to the valve seat, a valve actuator configured to move the valve between the open and closed positions in accordance with a timing relative to rotation of the shaft, a timing adjustment device powered by an electrical system and configured to adjust the timing, a control module configured to determine a target timing and to send an output signal to the timing adjustment device to adjust the timing towards the target timing, at least a first electrical component powered by the electrical system, the first electrical component being selectively operable by a user and causing a significant voltage drop in the electrical system when activated, and means for adjusting a magnitude of the output signal when the first electrical component is activated.

23. An internal combustion engine comprising an engine body, a movable member movable relative to the engine body, the engine body and the movable member together defining a combustion chamber, the engine body defining intake and exhaust ports communicating with the combustion chamber, an air induction system communicating with the combustion chamber through the intake port, an exhaust system communicating with the combustion chamber through the exhaust port, an intake valve arranged to move between an open position and a closed position of the intake port, an exhaust valve arranged to move between an open position and a closed position of the exhaust port, a valve actuator arranged to actuate one of the intake valve and the exhaust valve, a valve actuator adjustment mechanism including an electric actuator configured to adjust an actuating timing of the valve actuator at which the valve actuator actuates the intake valve or the exhaust valve, a control module configured to direct a power control signal to the electric actuator based upon a control characteristic, the control module configured to increase the power control signal when a second electrical component is operated.

* * * * *